US009266643B2

(12) United States Patent
Marcus et al.

(10) Patent No.: US 9,266,643 B2
(45) Date of Patent: Feb. 23, 2016

(54) PROTECTIVE SLEEVES FOR CONTAINERS

(71) Applicant: Lifefactory, Inc., Sausalito, CA (US)

(72) Inventors: Pamela Wong Marcus, Kensington, CA (US); Daren Edward Joy, Sausalito, CA (US)

(73) Assignee: Lifefactory, Inc., Sausalito, CA (US)

( * ) Notice: Subject to any disclaimer, the term of this patent is extended or adjusted under 35 U.S.C. 154(b) by 0 days.

(21) Appl. No.: 14/034,874

(22) Filed: Sep. 24, 2013

(65) Prior Publication Data

US 2014/0034660 A1 Feb. 6, 2014

Related U.S. Application Data

(63) Continuation of application No. 12/204,764, filed on Sep. 4, 2008, now Pat. No. 8,579,133.

(60) Provisional application No. 60/967,537, filed on Sep. 4, 2007.

(51) Int. Cl.
*B65D 23/00* (2006.01)
*A61J 9/08* (2006.01)
(Continued)

(52) U.S. Cl.
CPC ..... *B65D 23/001* (2013.01); *A47G 23/02* (2013.01); *A61J 9/08* (2013.01); *B65D 23/0871* (2013.01); *B65D 25/20* (2013.01); *B65D 81/022* (2013.01); *Y10T 428/24488* (2015.01)

(58) Field of Classification Search
CPC ..... A61J 11/008; A61J 9/08; A61J 9/00; A61J 9/008; A61J 11/045
USPC ..... 215/11.6, 11.1, 12.2, 392; 206/459.5, 206/466; 220/62.12, 737, 739; D3/229, D3/265; D7/507, 523; 229/403; 428/157
See application file for complete search history.

(56) References Cited

U.S. PATENT DOCUMENTS 1,319,297 A 10/1919 Limacher
1,690,509 A 11/1928 Thoreson et al.
(Continued)

FOREIGN PATENT DOCUMENTS

CN 2563109 7/2003
DE 1931942 U 2/1966
(Continued)

OTHER PUBLICATIONS

Notice of Allowance and Fees dated Sep. 25, 2013 for U.S. Appl. No. 12/204,764.
(Continued)

*Primary Examiner* — Fenn Mathew
*Assistant Examiner* — Cynthia Collado
(74) *Attorney, Agent, or Firm* — The Mueller Law Office, P.C.

(57) ABSTRACT

Aspects of the invention include a sleeve or wrap for protecting a container. In certain embodiments, the sleeve or wrap is a protective encasement for protecting a container, such as a bottle. In certain embodiments, the sleeve or wrap includes a body with a lumen, wherein the body is configured for holding and/or containing the container. For instance, in one embodiment, the protective sleeve includes a tubular body and at least a first opening in the protective body that is adapted for receiving the container. In certain embodiments, the body of the sleeve includes silicone. Accordingly, in certain embodiments, the sleeve is a protective silicone sleeve that is adapted to hold and/or contain a container, thereby protecting the container from damage (e.g., breaking). Also provided is a system for protecting a container that includes a protective sleeve, as described above, and a container that is configured for being associated, e.g., fit within, the protective sleeve.

26 Claims, 15 Drawing Sheets

(51) Int. Cl.

| | |
|---|---|
| ***B65D 23/08*** | (2006.01) |
| ***A47G 23/02*** | (2006.01) |
| ***B65D 25/20*** | (2006.01) |
| ***B65D 81/02*** | (2006.01) |

(56) References Cited

U.S. PATENT DOCUMENTS

| | | | | |
|---|---|---|---|---|
| 2,464,069 | A | 3/1949 | Benson | |
| 3,374,298 | A * | 3/1968 | Studen | A47G 23/0216 215/395 |
| 3,567,059 | A | 3/1971 | Littman | |
| 3,620,491 | A | 11/1971 | Baclit | |
| 3,718,360 | A | 2/1973 | Knutzen | |
| 3,729,859 | A | 5/1973 | Smith et al. | |
| 3,760,968 | A | 9/1973 | Amberg et al. | |
| 3,765,453 | A | 10/1973 | Parkinson | |
| 3,768,156 | A | 10/1973 | Caird et al. | |
| 3,967,333 | A | 7/1976 | Boyd | |
| 3,993,274 | A | 11/1976 | Jansen | |
| 4,067,949 | A | 1/1978 | Karabedian | |
| 4,076,139 | A | 2/1978 | Larson | |
| 4,228,908 | A | 10/1980 | Tweeton | |
| 4,296,902 | A | 10/1981 | Dachtler | |
| 4,344,303 | A | 8/1982 | Kelly | |
| 4,510,665 | A | 4/1985 | Scheurer | |
| 4,514,995 | A | 5/1985 | Curtis et al. | |
| 4,545,491 | A | 10/1985 | Bisgaard et al. | |
| 4,564,957 | A | 1/1986 | Scharf | |
| D290,922 | S | 7/1987 | Herrera | |
| 4,684,672 | A | 8/1987 | Buchanan et al. | |
| 4,726,551 | A | 2/1988 | Randall et al. | |
| 4,748,903 | A | 6/1988 | Fereshetian | |
| 4,777,087 | A | 10/1988 | Heeks et al. | |
| 4,798,671 | A | 1/1989 | Mijers et al. | |
| 4,832,213 | A | 5/1989 | Sharon et al. | |
| 4,909,249 | A | 3/1990 | Akkas et al. | |
| 4,925,895 | A | 5/1990 | Heeks et al. | |
| 4,973,504 | A | 11/1990 | Romberg et al. | |
| 4,986,827 | A | 1/1991 | Akkas et al. | |
| 4,989,811 | A | 2/1991 | Millis et al. | |
| 5,000,994 | A | 3/1991 | Romberg et al. | |
| 5,016,845 | A | 5/1991 | Pellegrino | |
| 5,019,035 | A | 5/1991 | Missirlian et al. | |
| 5,027,838 | A | 7/1991 | Iaia et al. | |
| 5,067,328 | A | 11/1991 | Medina et al. | |
| 5,078,287 | A | 1/1992 | Holmes, III | |
| 5,133,098 | A | 7/1992 | Weber | |
| 5,147,067 | A * | 9/1992 | Effertz | B65D 81/3879 220/739 |
| 5,166,031 | A | 11/1992 | Badesha et al. | |
| 5,183,229 | A | 2/1993 | Duggan | |
| 5,184,796 | A | 2/1993 | Maher | |
| 5,192,041 | A | 3/1993 | Bryant | |
| 5,269,368 | A | 12/1993 | Schneider et al. | |
| D345,897 | S | 4/1994 | Vitez | |
| 5,370,931 | A | 12/1994 | Fratangelo et al. | |
| 5,383,906 | A | 1/1995 | Burchett et al. | |
| 5,408,068 | A | 4/1995 | Ng | |
| 5,419,427 | A | 5/1995 | Wurgler | |
| 5,423,982 | A | 6/1995 | Jungbauer et al. | |
| 5,480,938 | A | 1/1996 | Badesha et al. | |
| 5,538,211 | A | 7/1996 | Dewey et al. | |
| 5,542,526 | A | 8/1996 | Wurgler | |
| 5,558,200 | A | 9/1996 | Whitby et al. | |
| 5,573,153 | A | 11/1996 | Stillman | |
| 5,609,759 | A | 3/1997 | Nohren, Jr. et al. | |
| 5,624,090 | A | 4/1997 | Gammelgaard | |
| 5,632,420 | A | 5/1997 | Lohrman et al. | |
| 5,635,232 | A | 6/1997 | Wallace | |
| 5,638,968 | A | 6/1997 | Baron et al. | |
| 5,664,746 | A | 9/1997 | Benzakarya | |
| 5,667,135 | A | 9/1997 | Schaefer | |
| 5,692,257 | A | 12/1997 | Albertieri | |
| 5,718,676 | A | 2/1998 | Barrett | |
| 5,727,842 | A | 3/1998 | O'Neil | |
| 5,762,996 | A | 6/1998 | Lucas et al. | |
| 5,775,019 | A | 7/1998 | Johnson | |
| 5,795,332 | A | 8/1998 | Lucas et al. | |
| 5,809,867 | A | 9/1998 | Turner et al. | |
| 5,820,084 | A | 10/1998 | Trumbauer et al. | |
| 5,871,184 | A | 2/1999 | Kaopio | |
| 5,873,551 | A | 2/1999 | Jones | |
| 5,917,167 | A | 6/1999 | Bestel | |
| 5,927,661 | A | 7/1999 | Tinsley et al. | |
| 5,935,096 | A | 8/1999 | Barrett | |
| 5,941,437 | A | 8/1999 | Okumura | |
| 5,970,971 | A | 10/1999 | Wu | |
| 5,989,209 | A | 11/1999 | Barrett | |
| 6,000,664 | A | 12/1999 | Hood | |
| 6,003,821 | A | 12/1999 | Fabian et al. | |
| 6,019,245 | A | 2/2000 | Foster et al. | |
| 6,041,952 | A | 3/2000 | Martin | |
| 6,079,316 | A | 6/2000 | Barden et al. | |
| 6,082,681 | A | 7/2000 | Rand | |
| 6,089,418 | A | 7/2000 | Gaiser et al. | |
| 6,098,934 | A | 8/2000 | Skelton | |
| 6,138,847 | A | 10/2000 | Johnson | |
| 6,158,870 | A | 12/2000 | Ramirez | |
| 6,210,352 | B1 | 4/2001 | Williams et al. | |
| 6,221,447 | B1 | 4/2001 | Munn et al. | |
| 6,295,681 | B1 | 10/2001 | Dolah | |
| 6,295,920 | B1 | 10/2001 | Barden et al. | |
| 6,311,861 | B1 | 11/2001 | Policappelli | |
| 6,334,231 | B2 | 1/2002 | Safieh | |
| 6,355,024 | B1 | 3/2002 | Small et al. | |
| 6,398,766 | B1 | 6/2002 | Branch | |
| 6,410,896 | B2 | 6/2002 | Witonsky et al. | |
| 6,417,498 | B1 | 7/2002 | Shields et al. | |
| 6,458,346 | B1 | 10/2002 | Howett et al. | |
| 6,464,100 | B2 | 10/2002 | Canfield | |
| 6,468,261 | B1 | 10/2002 | Small et al. | |
| 6,523,711 | B1 | 2/2003 | Hughes et al. | |
| 6,523,792 | B2 | 2/2003 | Fishler | |
| 6,592,084 | B1 | 7/2003 | Nile | |
| 6,599,271 | B1 | 7/2003 | Easley | |
| 6,607,087 | B2 | 8/2003 | Turnwald | |
| 6,623,455 | B2 | 9/2003 | Small et al. | |
| 6,635,242 | B2 | 10/2003 | Howett et al. | |
| 6,641,094 | B2 | 11/2003 | Fishler | |
| 6,703,590 | B1 | 3/2004 | Holley, Jr. | |
| 6,814,253 | B2 | 11/2004 | Wong | |
| 6,824,112 | B2 | 11/2004 | Lange | |
| 6,844,409 | B2 | 1/2005 | Angeletakis et al. | |
| 6,871,751 | B2 | 3/2005 | Kerns et al. | |
| 6,920,991 | B2 | 7/2005 | Holley, Jr. | |
| 6,921,880 | B2 | 7/2005 | Berger | |
| 6,946,172 | B2 | 9/2005 | Munn et al. | |
| 6,954,942 | B2 | 10/2005 | Austin | |
| 6,961,961 | B1 | 11/2005 | Ezra | |
| 6,972,309 | B1 | 12/2005 | Wideman et al. | |
| 6,991,126 | B2 | 1/2006 | Jaeckel | |
| 7,012,541 | B2 | 3/2006 | Ibguy | |
| 7,032,248 | B1 | 4/2006 | Gutilla | |
| D523,706 | S | 6/2006 | Hicks et al. | |
| 7,059,387 | B2 | 6/2006 | Kolowich | |
| 7,060,769 | B2 | 6/2006 | Angeletakis | |
| 7,060,770 | B2 | 6/2006 | Angeletakis | |
| 7,150,354 | B2 | 12/2006 | Snell | |
| 7,173,097 | B2 | 2/2007 | Angeletakis | |
| 7,196,293 | B2 | 3/2007 | Britto | |
| 7,208,549 | B2 | 4/2007 | Wideman et al. | |
| 7,287,386 | B2 | 10/2007 | Upadhye et al. | |
| 7,316,035 | B2 | 1/2008 | Archambault | |
| 7,318,656 | B1 | 1/2008 | Merine | |
| 7,337,915 | B1 | 3/2008 | Weldon | |
| D585,558 | S | 1/2009 | Feeley et al. | |
| D635,685 | S | 4/2011 | Hendricks et al. | |
| D644,072 | S | 8/2011 | Mcdonald et al. | |
| 2001/0008238 | A1 | 7/2001 | Witonsky et al. | |
| 2001/0009048 | A1 | 7/2001 | Safieh | |
| 2001/0009994 | A1 | 7/2001 | Small et al. | |
| 2001/0012549 | A1 | 8/2001 | Munn et al. | |
| 2001/0035387 | A1 | 11/2001 | Sutcliffe-Noyd | |
| 2002/0088768 | A1 | 7/2002 | Turnwald | |

(56) References Cited

U.S. PATENT DOCUMENTS

| | | | | |
|---|---|---|---|---|
| 2002/0104933 | A1 | 8/2002 | Fishler | |
| 2002/0134746 | A1 | 9/2002 | Reidenbach | |
| 2002/0162816 | A1 | 11/2002 | Walsh | |
| 2002/0190079 | A1 | 12/2002 | Hamamoto | |
| 2003/0015630 | A1 | 1/2003 | Fishler | |
| 2003/0108509 | A1 | 6/2003 | Howett et al. | |
| 2003/0111375 | A1 | 6/2003 | Kilmartin | |
| 2003/0141268 | A1 | 7/2003 | Kerns et al. | |
| 2003/0173491 | A1 | 9/2003 | Ibguy | |
| 2003/0183595 | A1 | 10/2003 | Huang | |
| 2003/0191418 | A1 | 10/2003 | Pillari | |
| 2003/0212233 | A1 | 11/2003 | Angeletakis et al. | |
| 2003/0218105 | A1 | 11/2003 | Sones et al. | |
| 2004/0035985 | A1 | 2/2004 | Fishler | |
| 2004/0061031 | A1 | 4/2004 | Lange | |
| 2004/0084460 | A1* | 5/2004 | Scheetz, II ..... | B65D 81/3879 220/739 |
| 2004/0094499 | A1 | 5/2004 | Huang | |
| 2004/0178163 | A1 | 9/2004 | Kerns et al. | |
| 2004/0188371 | A1 | 9/2004 | Holley | |
| 2004/0194470 | A1 | 10/2004 | Upadhye et al. | |
| 2004/0217102 | A1 | 11/2004 | Berger | |
| 2004/0225072 | A1 | 11/2004 | Angeletakis | |
| 2004/0225073 | A1 | 11/2004 | Angeletakis | |
| 2004/0230017 | A1 | 11/2004 | Kerns et al. | |
| 2004/0238540 | A1 | 12/2004 | Jackel et al. | |
| 2004/0254320 | A1 | 12/2004 | Angeletakis | |
| 2005/0061814 | A1 | 3/2005 | Jackel | |
| 2005/0072818 | A1 | 4/2005 | Howard | |
| 2005/0118239 | A1 | 6/2005 | Sabesan | |
| 2005/0132462 | A1 | 6/2005 | Archambault | |
| 2005/0143701 | A1 | 6/2005 | Snell | |
| 2005/0154361 | A1 | 7/2005 | Sabesan | |
| 2005/0178412 | A1 | 8/2005 | Koch et al. | |
| 2005/0186514 | A1 | 8/2005 | French et al. | |
| 2005/0238341 | A1 | 10/2005 | Thaler et al. | |
| 2005/0242770 | A1 | 11/2005 | Britto | |
| 2005/0282968 | A1 | 12/2005 | Wideman et al. | |
| 2005/0282970 | A1 | 12/2005 | Wideman et al. | |
| 2005/0288535 | A1 | 12/2005 | Wheland et al. | |
| 2006/0078656 | A1 | 4/2006 | Manning et al. | |
| 2006/0081640 | A1 | 4/2006 | Tobias | |
| 2006/0083710 | A1 | 4/2006 | Joerger et al. | |
| 2006/0102810 | A1 | 5/2006 | Banks | |
| 2006/0113270 | A1 | 6/2006 | Rea | |
| 2006/0162341 | A1 | 7/2006 | Milazzo | |
| 2006/0163301 | A1 | 7/2006 | Rhodes et al. | |
| 2006/0177489 | A1 | 8/2006 | Massouda et al. | |
| 2006/0186129 | A1 | 8/2006 | Allnutt et al. | |
| 2006/0241257 | A1 | 10/2006 | Angeletakis | |
| 2006/0263237 | A1 | 11/2006 | Holley | |
| 2006/0266667 | A1 | 11/2006 | Mendenhall et al. | |
| 2006/0273059 | A1 | 12/2006 | Mendenhall et al. | |
| 2006/0278598 | A1 | 12/2006 | Song | |
| 2006/0283205 | A1 | 12/2006 | Carriere | |
| 2007/0053855 | A1 | 3/2007 | Shelton et al. | |
| 2007/0061939 | A1 | 3/2007 | Rose | |
| 2007/0062994 | A1 | 3/2007 | Shoemaker et al. | |
| 2007/0068890 | A1 | 3/2007 | Roehrig | |
| 2007/0125725 | A1 | 6/2007 | Kemper et al. | |
| 2007/0148409 | A1 | 6/2007 | Rios et al. | |
| 2007/0193651 | A1 | 8/2007 | Kauzlarich | |
| 2007/0193908 | A1 | 8/2007 | Torchia et al. | |
| 2007/0203443 | A1 | 8/2007 | Pillari | |
| 2007/0211135 | A1 | 9/2007 | Moreland et al. | |
| 2007/0213214 | A1 | 9/2007 | Roth et al. | |
| 2007/0228228 | A1 | 10/2007 | Korbonski | |
| 2007/0231195 | A1 | 10/2007 | Holley | |
| 2007/0289982 | A1 | 12/2007 | Mandachescu | |
| 2008/0047967 | A1 | 2/2008 | Brunner et al. | |
| 2008/0058727 | A1 | 3/2008 | Domash et al. | |
| 2008/0078824 | A1 | 4/2008 | Spriegel et al. | |
| 2008/0081711 | A1 | 4/2008 | Chauvin et al. | |
| 2008/0290063 | A1* | 11/2008 | Marco ..... | B65D 23/0871 215/398 |

FOREIGN PATENT DOCUMENTS

| | | | |
|---|---|---|---|
| DE | 29718321 | | 2/1998 |
| DE | 102006028302 | A1 | 12/2007 |
| EP | 964653 | A | 12/1999 |
| EP | 1079790 | A | 3/2001 |
| EP | 1241107 | A | 9/2002 |
| EP | 1685864 | A | 8/2006 |
| EP | 1810707 | A | 7/2007 |
| EP | 1872768 | A | 1/2008 |
| FR | 822764 | A | 1/1938 |
| FR | 1093491 | A | 5/1955 |
| WO | 9822036 | | 5/1998 |
| WO | 9951127 | | 10/1999 |
| WO | 9959525 | | 11/1999 |
| WO | 0016673 | A | 3/2000 |
| WO | 0021484 | A | 4/2000 |
| WO | 0103757 | A | 1/2001 |
| WO | 02088247 | A | 11/2002 |
| WO | 02088254 | A | 11/2002 |
| WO | 03093351 | A | 11/2003 |
| WO | 2004091471 | A | 10/2004 |
| WO | 2004101667 | A | 11/2004 |
| WO | 2004101685 | A | 11/2004 |
| WO | 2005041733 | A | 5/2005 |
| WO | 2006041510 | A | 4/2006 |
| WO | 2007081944 | A | 7/2007 |

OTHER PUBLICATIONS

International Search Report and Written Opinion dated Nov. 19, 2008 for PCT Application PCT/US2008/075293.

Office Action Dated Apr. 11, 2013 for Canadian Application No. 2,697,180.

Patent Examination Report No. 1 dated Sep. 21, 2012 for Australian patent application No. 2008296191.

Office Action dated Nov. 19, 2014 for U.S. Appl. No. 14/327,391.

Notice of Allowance and Fees dated Jan. 6, 2014 for U.S. Appl. No. 29/468,444.

Feder, "All About: Silicone Products; It's a War Baby, Versatile Silicone Now Shows Up Everywhere", The New York Times, Dec. 29, 1991 (web and original versions).

Inter Partes Re-examination of U.S. Pat. No. 8,579,133, Declaration of Don Nole, Chief Executive Officer, Bigger Nineteens Co., Ltd, signed on Dec. 16, 2014.

Office Action dated Jan. 2, 2015 for U.S. Appl. No. 14/327,391.

Petition for Inter Partes Review of U.S. Pat. No. 8,579,133, *Leapfrog Product Development, LLC* vs. *Lifefactory, Inc.*; Jan. 23, 2015; 48 pages.

Amazon.com Price Comparison, Exhibit 2015 Submitted to the USPTO Before the Patent Trial and Appeal Board on Nov. 16, 2015, Case IPR2015-00614 U.S. Pat. No. 8,579,133, pp. 1-7.

Biello, Plastic (Not) Fantastic: Food Containers Leach a Potentially Harmful Chemical, Scientific American, Feb. 19, 2008, Accessed on Nov. 5, 2015,Exhibit 2016 Submitted to the USPTO Before the Patent Trial and Appeal Board on Nov. 16, 2015, Case IPR2015-00614 U.S. Pat. No. 8,579,133, pp. 1-6.

Curriculum Vitae of Jim Goldman CPP, Exhibit 2024 Submitted to the USPTO Before the Patent Trial and Appeal Board on Nov. 16, 2015, Case IPR2015-00614 U.S. Pat. No. 8,579,133, pp. 1-4.

Declaration of Jim Goldman, Exhibit 2009 Submitted to the USPTO Before the Patent Trial and Appeal Board on Nov. 16, 2015, Case IPR2015-00614 U.S. Pat. No. 8,579,133, pp. 1-53.

Declaration of Roy Mabrey, Exhibit 2011 Submitted to the USPTO Before the Patent Trial and Appeal Board on Nov. 16, 2015, Case IPR2015-00614 U.S. Pat. No. 8,579,133, pp. 1-7.

Deposition of Donald John Nole, Oct. 22, 2015, Exhibit 2021 Submitted to the USPTO Before the Patent Trial and Appeal Board on Nov. 16, 2015, Case IPR2015-00614 U.S. Pat. No. 8,579,133, pp. 1-117.

Excerpt from Lifefactory Retail Product Catalog, Exhibit 2019 Submitted to the USPTO Before the Patent Trial and Appeal Board on Nov. 16, 2015, Case IPR2015-00614 U.S. Pat. No. 8,579,133, p. 1.

FAQ, Lifefactory, Inc., Accessed on Nov. 5, 2015, Exhibit 2017 Submitted to the USPTO Before the Patent Trial and Appeal Board on

(56) References Cited

OTHER PUBLICATIONS

Nov. 16, 2015, Case IPR2015-00614 U.S. Pat. No. 8,579,133, pp. 1-5, https://www.lifefactory.com/faqs.
Healthy & Responsible, Lifefactory, Inc, Accessed on Nov. 5, 2015, Exhibit 2018 Submitted to the USPTO Before the Patent Trial and Appeal Board, Case IPR2015-00614 U.S. Pat. No. 8,579,133, pp. 1-2, https://www.lifefactory.com/healthy-responsible.
Industry Reviews updated with page dividers and paginated reduced, Exhibit 2020 Submitted to the USPTO Before the Patent Trial and Appeal Board on Nov. 16, 2015, Case IPR2015-00614 U.S. Pat. No. 8,579,133, pp. 1-40.
Patent Owner Lifefactory, Inc's Response, Submitted to the USPTO Before the Patent Trial and Appeal Board on Nov. 16, 2015, Case IPR2015-00614 U.S. Pat. No. 8,579,133, pp. 1-69.
Polygalales, McGraw-Hill Concise Encyclopedia of Science & Technology, Fifth Edition, 2005, pp. 1744-1748, The McGraw-Hill Companies, Exhibit 2023 Submitted to the USPTO Before the Patent Trial and Appeal Board on Nov. 16, 2015, Case IPR2015-00614 U.S. Pat. No. 8,579,133, pp. 1-7.
Polygene-Polyphony, American Heritage Dictionary of the English Language, Fourth Edition, 2006, Houghton Mifflin company, Exhibit 2022 Submitted to the USPTO Before the Patent Trial and Appeal Board on Nov. 16, 2015, Case IPR2015-00614 U.S. Pat. No. 8,579,133, pp. 1-3.
SPINSscan Natural, Spins LLC, Accessed on Oct. 29, 2015, Copyright 2013,Exhibit 2014 Submitted to the USPTO Before the Patent Trial and Appeal Board on Nov. 16, 2015, Case IPR2015-00614 U.S. Pat. No. 8,579,133, pp. 1-3, http://www.spins.com/scan-data/natural/.
US8579133 Claim Charts, Exhibit 2010 Submitted to the USPTO Before the Patent Trial and Appeal Board on Nov. 16, 2015, Case IPR2015-00614 U.S. Pat. No. 8,579,133, pp. 1-14.

* cited by examiner

10

PROTECTIVE SLEEVES FOR CONTAINERS

CROSS-REFERENCED TO RELATED APPLICATIONS

This application is a continuation of U.S. patent application Ser. No. 12/204,764 filed on Sep. 4, 2008, published as U.S. Patent Publication No. 2009/0057257 and entitled "Protective Sleeves for Containers"; which claims the benefit under 35 U.S.C. Section 119(e) of a provisional application U.S. Ser. No. 60/967,537, filed on Sep. 4, 2007 and entitled "Protective Sleeves for Containers" all of which are incorporated by reference herein in their entirety.

BACKGROUND OF THE INVENTION

Active lifestyles necessitate that those who engage in them constantly be on the go. Good health demands that those participating in such active living imbibe a large quantity of liquids, namely, water and other well known sports drinks. Being on the go, however, often presents the problem of needing to quench one's thirst and yet not having access to a source of liquid refreshment. Accordingly, fluid containers, such as drinking bottles, have been developed to meet such demands of active living and thereby enable those who would not ordinarily have access to liquid refreshment to store, transport, and make use of such refreshments at their convenience.

Often drinking containers used for the storing, transporting and accessing of liquid beverages are made out of plastic. Recently, however, there has been a large amount of publicity regarding the various dangers related to the chemical constituents from which the plastic containers have been made. Specifically, various chemical constituents from which plastic containers are typically made may leach into the liquid contents contained therein. This problem is of special concern where the contents of the storage container is the sole source of nutrition for the subject imbibing the contents therein.

For instance, parents are very concerned with respect to the leaching of harmful chemicals into milk or formula contained in the plastic type bottles that are often used in the feeding of their babies. Specifically, bisphenol A and/or phthalates, which may leak from plastic containers into the liquids (e.g., milk or formula) contained therein, may mimic the growing child's endogenous hormones and are, therefore, considered harmful to growing infants and children.

One way of overcoming this, and other associated problems, is the use of glass bottles. Glass, e.g., silicon-dioxide, as used in the production of glass bottles, is widely known to be inert with respect to the drinking liquids typically contained in such bottles, and is not subject to the same problem of leaching as are its plastic counterparts. A problem with glass, however, is its perceived fragility. Even though a glass bottle may be constructed to be extremely sturdy, there still persist a perception that glass bottles are prone to breaking. Such a perception may prevent the acceptance and use of glass bottles as fluid storage containers for those engaging in an active lifestyle and/or for those seeking the storage, transport, and access to fluid nutrients.

Accordingly, there is a need in the art for a mechanism that will allow a user to employ a storage container, such as glass, thereby being protected from the harmful effects of leaching that may be present when using plastic storage containers, and yet be free of the fear of the glass container breaking, which often persist in the minds of those engaging in an active lifestyle as well as parents with infant children. The present invention meets these and other such needs.

SUMMARY OF THE INVENTION

Aspects of the invention include a sleeve or wrap for protecting a container. In certain embodiments, the sleeve or wrap is a protective encasement for protecting a container, such as a bottle or a food storage container. In certain embodiments, the sleeve or wrap includes a body with a lumen, wherein the body is configured for holding and/or containing the container. For instance, in one embodiment, the protective sleeve includes a tubular body. The sleeve may also include at least a first opening that is adapted for receiving the container. In certain embodiments, the body of the sleeve includes silicone. Accordingly, in certain embodiments, the sleeve is a protective silicone sleeve that is adapted to hold and/or contain a container, thereby protecting the container from damage (e.g., breaking). Also provided is a system for protecting a container that includes a protective sleeve, as described above, and a container that is configured for being associated, e.g., fit within, the protective sleeve.

BRIEF DESCRIPTION OF THE DRAWINGS

According to common practice, the various features of the drawings may not be drawn to-scale. Rather, the dimensions of the various features may be arbitrarily expanded or reduced for clarity. Included in the drawings are the following figures:

FIG. 1 illustrates an embodiment of a protective sleeve in accordance with the disclosure.

FIG. 3 illustrates an embodiment of a protective sleeve and/or baby bottle system in accordance with the disclosure.

FIG. 4 illustrates another embodiment of a protective sleeve and/or baby bottle system in accordance with the disclosure.

FIG. 6 illustrates an embodiment of a sippy cup/closeable container system including a protective sleeve in accordance with the disclosure.

FIG. 7 illustrates an embodiment of a protective sleeve and/or drinking bottle system in accordance with the disclosure.

Figures 1A, 1B:
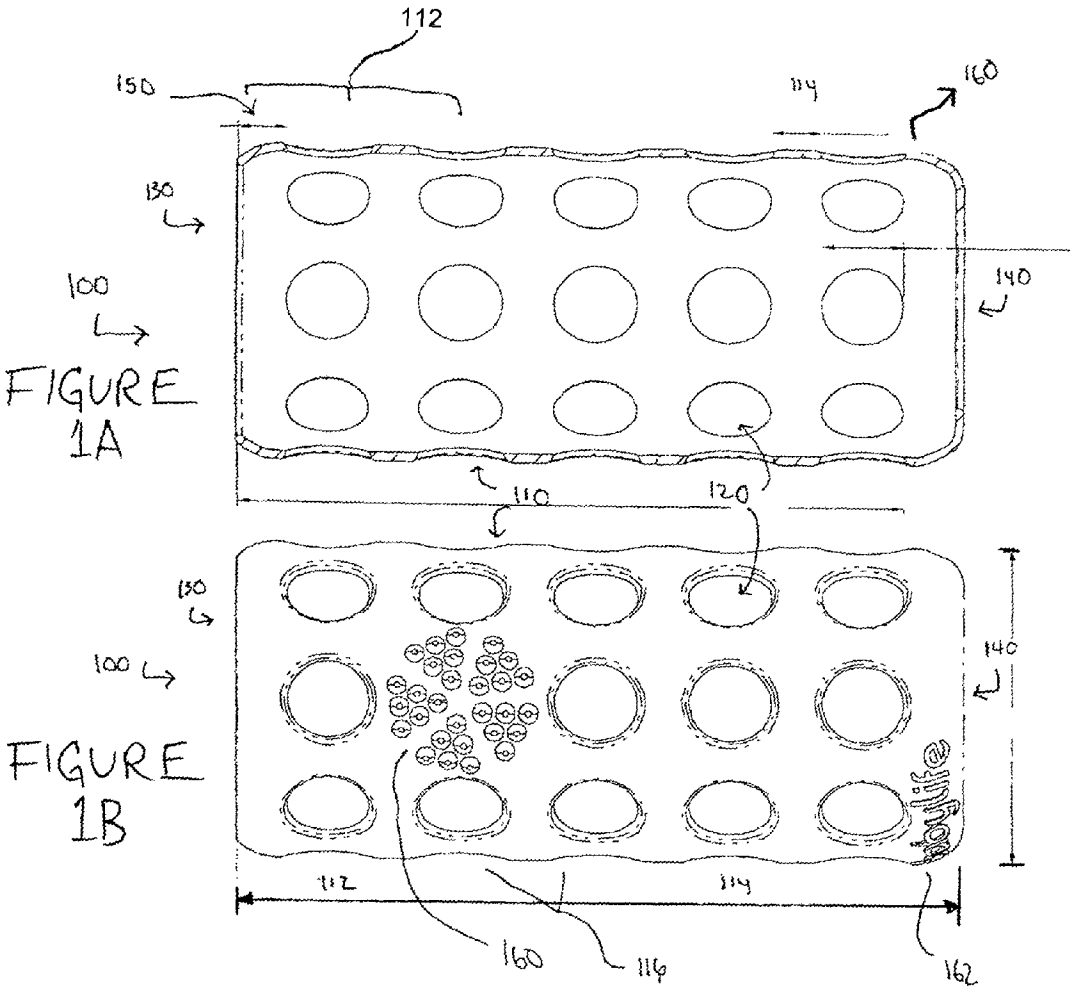
FIG. 1A represents one view of the protective sleeve.
FIG. 1B represents another view.

Before the present invention is further described, it is to be understood that this invention is not limited to particular embodiments described, as such may of course vary. It is also to be understood that the terminology used herein is for the purpose of describing particular embodiments only, and is not intended to be limiting. Unless defined otherwise, all technical and scientific terms used herein have the same meaning as commonly understood by one skilled in the art to which this invention belongs.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

Throughout this application, various publications, patents and published patent applications are cited. The disclosures of these publications, patents and published patent applications referenced in this application are hereby incorporated by reference in their entirety into the present disclosure. Citation herein by the Applicant of a publication, patent, or published patent application is not an admission by the Applicant of said publication, patent, or published patent application as prior art.

It must be noted that as used herein and in the appended claims, the singular forms "a", "and", and "the" include plural referents unless the context clearly dictates otherwise. Thus, for example, reference to an "opening" may include a plurality of such openings, and reference to "the gripping element" includes reference to one or more gripping elements and equivalents thereof known to those skilled in the art, and so forth. It is further noted that the claims may be drafted to exclude any optional element. As such, this statement is intended to serve as antecedent basis for use of such exclusive terminology as "solely", "only" and the like, in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

DETAILED DESCRIPTION

Aspects of the invention include a sleeve or wrap for protecting a container. In certain embodiments, the sleeve or wrap is a protective encasement for protecting a container, such as a bottle or a solid food container. In certain embodiments, the sleeve or wrap includes a body with a lumen, wherein the body is configured for holding and/or containing the container. For instance, in one embodiment, the protective sleeve includes a tubular body and at least a first opening in the protective body that is adapted for receiving the container. In certain embodiments, the body of the sleeve includes silicone.

Accordingly, in certain embodiments, the sleeve is a protective silicone sleeve that is adapted to hold and/or contain a container, thereby protecting the container from breaking. Also provided is a system for protecting a container that includes a protective sleeve, as described above, and a container that is configured for being associated, e.g., fit within, the protective sleeve.

The subject protective sleeves of the invention will be described first, followed by a description of the systems in which such protective sleeves may be employed. A discussion of representative uses of the subject materials is also presented.

Protective Sleeves and Systems

As summarized above, the subject invention provides a sleeve or wrap for holding and/or containing an object, such as a container. In certain embodiments, the sleeve is a protective sleeve that is configured for providing protection, e.g., from damage, for a container held therein. By "protective" or "protection" is meant that a sleeve of the subject invention is capable of adding an increased amount of fortification to the object, e.g., container, that is held and/or contained therein. For instance, in certain embodiments, the sleeve provides an object held within the sleeve an increased fortification against an undesired consequence than is exhibited by that same or a similar object that is not held within or otherwise associated with a protective sleeve of the subject invention. For example, in certain instances, a container within a protective sleeve of the invention is less prone to being damaged, e.g., breaking and, therefore, the protection provided by the sleeve is a protection from damage such as breakage. However, in other instances, the protection is from heat, cold, light, degradation, decay, and/or the like.

Any container may be held and/or contained within a protective sleeve of the subject invention. For instance, the container may be a glass container, a plastic container, a metal or metal alloy container, or the like. Specifically, if the container is made of glass, the glass may be of any suitable type of glass, such as silicon dioxide, sodalime glass, borosilicate glass, pyrex, lead crystal, and the like. If the container is made of metal, the metal may be of any suitable type of metal, such as aluminum, steel (e.g., stainless steel), tin, and the like. A container for use in accordance with the subject invention may also include alloys of any suitable metals. The container may also be a plastic, e.g., food, container, such as a TUPPERWARE® container.

The container may contain any material, such as a solid, liquid or gas. In certain embodiments, the container is a fluid container, for instance, that contains a liquid. The liquid within the container may be any form of liquid. In certain embodiments, the liquid is a liquid that is meant to be imbibed. For instance, in certain embodiments, the liquid is a liquid such as, water, milk, formula, liquid nutrients, juices, electrolytes, sports drinks, sodas, alcoholic beverages, and the like. In one embodiment, the liquid is milk, breast milk, or formula and the container is a glass or plastic baby bottle. For instance, the container may be a 4 ounce, 5 ounce, 6 ounce, 7 ounce, 8 ounce, 9 ounce, 10 ounce, etc. baby bottle and the protective sleeve is dimensioned so as to snuggly fit the baby bottle. In one embodiment, the liquid is water, an electrolyte solution, a sports drink, or the like, and the container is a glass or plastic sports-type bottle. For instance, the container may be an 8 ounce, 10, ounce, 12 ounce, 16 ounce, 32 ounce, 45 ounce, 64 ounce, etc. cup or bottle (e.g., a sports drink bottle) and the protective sleeve is dimensioned to snugly fit cup or bottle. In one embodiment, the liquid is a soda or alcoholic beverage, and the container is a can such as a metal or metal alloy can. In certain embodiments, the liquid is not meant to be imbibed, but rather is a chemical solution, such as an acidic or basic solution, that is contained within a container for which increased protection is sought. In certain embodiments, the container is a solid object container, for instance, a food container that contains a solid food.

In certain embodiments, the sleeve, e.g., protective sleeve, is configured to hold and/or contain a container. Accordingly, the sleeve includes a body with a lumen. The body is extended and includes a lumen into which a suitable container may be inserted. Hence, in certain embodiments, the sleeve includes at least a first opening that is adapted for receiving the container, and the sleeve includes an extended body that is configured for at least partially holding and/or containing the container.

In one embodiment, the body of the protective sleeve is an extended tubular body that includes a first opening for receiving a container and may include an additional opening separated from the first opening by the extended tubular body. Accordingly, in certain embodiments, the sleeve includes an additional (e.g., second) opening that is separated from the first opening by an extended tubular body of the sleeve. For instance, the sleeve may include both a first end and a second end, wherein the first and second ends are separated by a tubular body and the first and second ends may include openings. In certain embodiments, the sleeve includes an extended body with a first opening positioned at a first end of the tubular body, however, at a second end of the tubular body a second opening is not present, but rather the tubular body is configured such that the second end is closed or enclosed. In certain embodiments, the tubular body of the sleeve includes at least one lip element that is configured for retaining a container that is inserted or otherwise held within the sleeve. In certain embodiments, the lip element is coextensive with the tubular body of the sleeve and forms the first and/or second openings. For instance, in certain embodiments, a first and/or second lip surround the openings. In certain embodiments, the extended body is not tubular but includes a lumen and a first opening that is bounded by four sides and a bottom member.

For instance, in certain embodiments, e.g., wherein the sleeve includes an extended tubular body, and a first opening through which a container must pass so as to be contained within the protective sleeve, the first opening may be configured to taper inward so as to follow the contour of the neck of a container and may provide a liplike opening but with or without the presence of an actual lip. In such an embodiment, the thickness of the protective sleeve at the first opening may be consistent with the rest of the tubular body or may be thinner or may be thicker as desired. For example, in one embodiment, the first opening includes a defined lip to help secure the protective sleeve in place around the neck portion of a container body, in such an embodiment, the thickness of the protective sleeve may increase to produce an added elasticity so as to hold the protective sleeve in place during use.

In certain embodiments, where a second opening is provided, the second opening may be configured such that a container may not pass through the second opening, for example, where the second opening is configured to tightly fit and/or conform to the bottom of a container, thus retaining the container and allowing for visual access. Hence, in certain embodiments, the second opening of the protective sleeve may be contoured to follow the shape of the container and may form a natural lip of the same thickness as the rest of the tubular body.

In certain embodiments, the extended body includes a proximal and a distal portion with proximal and distal ends. In certain embodiments, the proximal or distal portions may be tapered toward the proximal and/or distal ends. In certain embodiments, the proximal end includes an opening that is configured for receiving a container, and the distal end is configured for retaining a received container. For instance, in certain embodiments, the distal end includes an opening that is configured for retaining a received container. In one embodiment, the distal end includes an opening with a lip that is configured to retain a received container. In certain embodiments, the distal end does not include an opening. Rather, in certain embodiments, the distal end includes a bottom member or an enclosure that is configured for retaining a received container. In certain embodiments, the proximal end includes a top member or enclosure that is configured so as to allow a container to be received there through and being closed thereafter. In certain embodiments the enclosure element is adapted to be removable. In certain embodiments, the extended body includes a plurality of sides, e.g., three or four or more sides and a bottom.

In certain embodiments, the proximal opening and/or lip is configured for receiving and retaining a container. For instance, in certain embodiments, the proximal sleeve portion and/or lip that forms the opening is adapted to stretch and/or otherwise move from a first non-extended position to a second, extended or stretched position, wherein in the first (or second) position the sleeve and opening are configured to retain a container, and in the second (or first) position the sleeve and opening are configured to receive a container. In certain embodiments, a cap or lid element is also included, wherein the cap or lid element is configured for being removably associated with the proximal opening and/or lip of the body (e.g., a tubular body). For example, in certain embodiments, two or more of the container, e.g., a bottle, protective sleeve, lid element, spout, and/or retaining element may form a system, as described in more detail herein below.

The removable lid or removable enclosure element may include a securing element that is configured for removably associating the lid or enclosure element with the body. The securing element may be any type of securing element well known in the art. For instance, the body and/or lid or enclosure may be configured for being associated with one another through a screw-like interaction, through the means of a snap or button, through a hook and loop fastener attachment like interaction (e.g., VELCRO™), through a zipper, a draw string, and the like. Additionally, the lid or cap may include a loop element to facilitate carrying and/or securing of the lid to the bottle when the lid is not in use. In certain embodiments, the loop element may be a molded loop element affixed to the top of the cap.

In certain embodiments, the protective sleeve increases the gripability of the container to which it is associated. In certain embodiments, a protective sleeve of the subject disclosure includes a gripping element. For instance, in certain embodiments, the body of the sleeve and/or the cap or lid, and/or the enclosure element may include one or more gripping elements, such as, but not limited to: an indentation, a groove, ribbing, a gripping nub, a molded handle, and/or a raised surface element. In one embodiment, a component of the sleeve, e.g., body, lid and/or enclosure, includes a raised or indented surface element, wherein the raised or indented surface element may be, for example, one or more letters, words, sentences, measurement indicators, designs, shapes, or other such figures that are formed within or otherwise associated with a component of the protective sleeve.

Specifically, the raised or indented surface element may not only serve the purpose of enhancing gripping but may also be used to communicate one or more meanings to a user. For instance, the raised or indented surface element may be configured to communicate a word or phrase such as a brand name, e.g., BABYLIFE™, or LIFEFACTORYT™, or marketing slogan, or may be a contoured image and/or shapes. Additionally, the raised or indented surface element may include a measurement indicator, washing and cleaning instructions, a website address, or the like.

In certain embodiments, the extended body of the protective sleeve includes one or more holes in addition to the first and/or second openings (e.g., the openings that are configured for receiving and/or retaining a container, respectively). For instance, in certain embodiments, the extended body of the protective sleeve includes one or more holes that are configured for allowing a user to see a level of the contents of an inserted container. Although the one or more holes may have any shape, such as an extended, round or circular, a square, a rectangle, a triangle, or other such shaped hole. In certain embodiments, the body includes either a single or plurality of elongated holes that may run along a portion or along substantially all of the length of the elongated body. The holes may be evenly distributed around the body or may be in a designed pattern, or randomly distributed. The holes may all be of the same size or of one or more different sizes. For instance, the holes can have a brick like shape or may have a free-form design or other suitable design. For instance, in certain embodiments, the protective sleeve includes a honeycomb, floral, and/or other natural design. In certain embodiments, the protective sleeve does not have any additional holes.

For instance, in certain embodiments, the body includes a plurality of circular holes. In certain embodiments, the plurality of circular holes are randomly distributed along a portion and/or the entire length of the body. In certain embodiments, the plurality of circular holes are substantially uniformly configured along a portion and/or the entire length of the body. In this manner, the amount, level, and/or contents of an associated container may be observed. Further, through the inclusion of one or more holes in the body, the contents within the container may more readily be associated with the application or withdrawal of thermal energy to or from the container and/or its contents, and/or may readily allow the container and/or its contents to be contacted by light, radiation, X-rays, or the like. In certain embodiments, the one or more holes pass entirely through the width of the body and are uncovered. In certain embodiments, the one or more holes pass entirely through the width of the body and are covered, for instance, with a window element, such as plastic and/or a hole covering element that may serve as a flap that is adapted to removably cover a hole.

In certain embodiments, the body and/or lid or cap and/or the enclosure elements of the protective sleeve or wrap do not contain additional holes, but rather are configured for preventing light and/or thermal energy from contacting, being transferred to or from a held container and/or the contents thereof. Accordingly, in certain embodiments, the protective sleeves of the subject invention are configured for preventing light from contacting a container held within the sleeve and/or are configured for slowing and/or minimizing the transfer of heat into or out of a held container.

In certain embodiments, the protective sleeve is lightweight, flexible, and configured for receiving a container therein and protecting the container in and of itself, without further being associated with any other additional elements such as an enclosure, an additional, e.g., outer, sleeve, etc. For instance, where it is desired to rapidly transfer heat through the protective sleeve, the protective sleeve may be adapted so as to be thin and to enwrap and/or otherwise at least partially enclose a container and to perform this function without further combination with an additional, outer sleeve element. For example, in certain embodiments, it may be desirable to have a protective sleeve that may be rapidly applied to or removed from a container, and in such instances, it may be desirous to configure the sleeve so as to not include an additional outer sleeve in order to perform its function. Hence, in certain embodiments, a system is provided wherein the system includes a protective sleeve, as described herein, and one or more of a lid element, a nozzle or nipple element, a locking element, and the like, however, does not include an additional, e.g., an outer, sleeve or wrap element.

In certain embodiments, a protective sleeve of the subject invention includes a body that further includes an insulating material. In certain embodiments, the body includes a plurality of layers. For instance, in certain embodiments, the body includes a first and a second layer. Specifically, in certain embodiments, the body may include a first layer that forms an interior layer, e.g., a layer that contacts a container that is held or contained within the protective sleeve, and a second, e.g., exterior, layer that is separated from a contained container by at least the first, interior layer. Further, in this embodiment, the body may include a filler material that at least partially separates the first and second layers of the body.

Hence, in certain embodiments, the body includes an insulating material between the first and second layers of the body. Any suitable insulating material may be used to form an insulating layer between the first and second layers of the body. For instance, a suitable insulating material may be a material that is designed to prevent the transfer of heat into or out of the container, or may be a material that is designed to transfer heat to or away from the container and/or its contents.

Specifically, in certain embodiments, a suitable insulating material may be a material capable of absorbing heat from, or transferring heat to, a held or contained item. Accordingly, in one embodiment the insulating material is a material that is configured for absorbing heat from a contained object. For instance, in certain embodiments, the insulating material includes, but is not limited to: ammonium nitrate, liquid nitrogen, water, or the like. In certain embodiments, the insulating material may be cooled or frozen by placing the protective sleeve within an appropriate cold environment, such as but not limited to a refrigerator, cold room, freezer, or the like.

In certain embodiment, a suitable insulating material is a material that is configured for transferring heat to a contained object. For instance, in certain embodiments, the insulating material includes, but is not limited to: hot water, calcium chloride, or the like. In certain embodiments, the heat transferring material may be heated by placing the protective sleeve within an appropriate warm environment, such as but not limited to a stove, oven, microwave, boiling fluid (e.g., a boiling liquid such as water), or the like. Accordingly, a protective sleeve of the disclosure may be microwave and/or freezer safe.

In certain embodiments, the protective sleeve is configured in such a way so that the insulating material may be added or removed from between the outer and inner layers of the body (e.g., the insulating material is replaceable). Accordingly, in this embodiment, the container assembly may include a nozzle, stem, or the like, for the introduction and removal of an insulating material in between the outer and inner layers of the body.

In certain embodiments, the body is formed from a single layer, e.g., the body only includes a singular layer and does not include a second or additional layer. For instance, in certain embodiments, the body is formed from a single layer of material. Specifically, although the protective sleeves or wraps of the invention may be fabricated in any suitable manner from any suitable material, in certain embodiments, the protective sleeves are fabricated by a molding technique, such as a compression molding or liquid injection molding technique, depending on the particular characteristics that the protective sleeve is to include. For example, where the protective sleeve is designed to protect a bottle, the body of the sleeve may be fabricated using compression molding, during which process a colorant, heat, and/or other chemical additives, may be added to the sheet blanks, which become the compression molded end product, for instance, to color and/or to aid in the release of the product from the molds. Single cavity or family molding (multi cavity) may be employed.

Accordingly, in certain embodiments, the protective sleeve and/or one or more of the components thereof includes one or more identifying colors. Any single color or a mixture of colors may be used. For instance, the one or more colors of the sleeve may be one or more of red, yellow, blue, medium blue, pink, raspberry, orange, or the like. For example, the colorant to be added to the precursor material (e.g., silicone material blank, may include, Light Blue—Sky, Medium Blue—Ocean, Light Pink—Rose, Raspberry, Yellow and Orange, or other natural tones, seasonal colors, stylistic color ranges such as "retro future", Art Deco, Primative, and the like. Hence, in certain embodiments, a food grade colorant is added to the raw blank material, e.g., silicone that is made into sheets from which the sleeves are to be cut and molded, during the compression or extrusion molding manufacturing process. Additionally, glitter and/or one or more scents may also be added.

In certain embodiments, the sleeve does not have an additional color but rather retains the color of the material from which it is made. In certain embodiments, the sleeve or its components, is translucent or see-through. In certain embodiments, the sleeve comprises a material that changes color. For instance, in certain embodiments, the sleeve includes a material that changes color when exposed to an environmental stimulus, such as sunlight, temperature, radiation, or the like. In certain embodiments, the colors represent symbols which are capable of conveying a message, such as hot, cold, clean, dirty or the like.

In certain embodiments, the body includes one or more layers wherein each layer includes an exterior and an interior surface. In certain embodiments, one or more of the interior and/or exterior surfaces includes a coating layer. For instance, in certain embodiments, a surface of the body, cap or lid or enclosure elements have been coated with a surface coating material in such a manner so as to produce a coating layer. In one embodiment, the surface coating material may include a material such as a silicon, TEFLON™, a metallic material, a plastic coating, or the like.

In certain embodiments, the protective sleeve and/or one or more of the components thereof includes an attachment element. For instance, in certain embodiments, an attachment element is included so as to facilitate the carrying or securing of the protective sleeve and/or container. The attachment element may be any form of attachment element known in the art, such as but not limited to a snap, string or draw string, button element, a clip, a handle, zip-fastener (e.g., a zipper mechanism), hook and loop fastener attachment (e.g., VELCRO™), a screw element, a hook element, or the like. One or more components of the protective sleeve may also include a sensor indicator for indicating the temperature of a contained item (for instance, a thermo strip).

The protective sleeves, and/or components thereof, of the subject invention may be constructed in any manner from any suitable material well known in the art, usually including those used in the fabrication industry for the manufacture of protective articles. In certain embodiments, a suitable material is a material that does not include any harmful chemical constituents that may leach from the material and possibly be ingested if the protective sleeve is contacted with a mouth of a user. Accordingly, in certain embodiments, the material from which the protective sleeve is made is not a plastic material. In certain embodiments, the material is an FDA approved material. In certain embodiments, not only does the material not include harmful chemical constituents that may leach out of the material, the material is also FDA approved, and/or the material is capable of withstanding high temperatures, for instance, temperatures up to about 100° C., or up to about 400° C., up to about 600° C., even up to about 800° C. or more. For example, in certain embodiments, the material is capable of being placed in a boiling liquid, e.g., water, or dishwasher, autoclave, or the like, and withstanding the high temperatures therein without being adversely effected. In certain embodiments, the material is microwave safe, that is the material is capable of being heated within a microwave and not melting, degrading, or otherwise appreciably being broken down.

Accordingly, in certain embodiments, a suitable material, may be one or more of an elastic material, a foamed or vulcanized rubber, neoprene, polyurethane, nylon, lycra, non-toxic plastic, silicone, and/or a silicone containing material. In certain embodiments, a protective sleeve of the invention includes a polymerized siloxane, such as silicone, e.g., silicone such as that produced by G.E. or Dow Chemicals. For instance, in certain embodiments, the protective sleeve is molded as a single piece from a precursor material blank that is up to 35%, up to 40%, up to 50%, up to 55%, up to 60%, up to 65%, up to 70%, up to 80%, up to 85%, up to 90%, up to 95% up to 98%, up to 99%, up to 99.9% and including up to 100% silicone. Hence, the material from which the sleeve is produced may be fabricated into a sheet and compression or liquid injection molded into a protective sleeve of the invention.

In certain embodiments, a protective sleeve of the invention and the material from which it is fabricated is hygienic, light weight and flexible such that the material is capable of expanding so as to allow the sleeve to expand around the contours of a container to be received therein and snuggly fit around the container once the container has been received. Hence, in certain embodiments the sleeve and the material from which it is fabricated is capable of stretching from its original configuration so as to receive a container, and yet configured for returning to its original configuration once the container has been removed from the sleeve.

Accordingly, in certain embodiments, the sleeve is made from a single piece of shaped or otherwise molded material that has elastic properties, such that the sleeve can deform to receive a container, and then reform to its original configuration automatically, that is without the need for external manipulation. In certain embodiments, the single piece of material is such that it can also serve as an insulator keeping the fluids in a received container warm or cold, without the need for an intervening insulating material and/or layer. The sleeve or wrap can be made into any desired shape such as a tube, a square or rectangular box, a triangular, pyramidal or circular shape, or the like. And thus the sleeve or wrap may be configured for fitting any suitable container, such as a round, circular, triangular, square, rectangular, cube shaped container, or the lie, and may be of regular or irregular dimensions, so as to fit a variety of bottles, jars, and the like, e.g., a mason type jar, baby food jar, lunch box container, etc.

The dimensions of the sleeve may vary depending upon what container the sleeves are configured to contain and/or protect. In certain embodiments, for instance, where the sleeve is configured to contain and/or protect a bottle, the sleeve may include an interior diameter in the range from about 0.5 inch or less interior diameter to about 10 inches or more interior diameter, including, 0.75 inches interior diameter to about 5 inches interior diameter, such as about 2 or 2.25 inches interior diameter or less. In certain embodiments, the outer diameter of the sleeve may include an outer diameter in the range of from about 1 inch or less to about 15 inches or more, including, 2 inches to about 5 inches, such as about 2.25 or 2.375 inches outer diameter. Additionally, the diameter of the first and/or second openings may range from about 0.025 inch or less to about 5 inches or more, including about 1 inch to 4 inches, such as about 2 or about 2.25 inches to 3 inches. In certain embodiments, the first opening has diameter that is greater than a second opening, for example, where the first opening has a diameter of about 2 to 2.25 inches, the diameter of the second, opening may include about 1.5 inches to about 1.75 inches.

The thickness of the sleeve may range from about 0.1 inches or less to about 0.5 inches or more, including from about 0.15 inches to about 0.4 inches, for instance, from about 0.18 inches to about 0.35 inches, such as from about 0.1875 inches to about 0.3 inches, including from about 0.2 inches to about 0.25 inches. In certain embodiments, the thickness is less than 1 cm, for instance, less than 0.75 cm, and may even be less than 0.5 cm. In certain embodiments, the thickness is greater than 3 cm, for instance greater than 3.5 cm, such as greater than 4 cm, even greater than 5 cm. The length of the body may range from about 1 inch or less to about 20 inches or more, including about 2 or 3 inches to about 18 inches, such as about 4 or 5 inches to about 10 or about 15 inches, and may be from about 5.25 to about 5.75 inches, including the distal and proximal ends.

In one aspect, the subject invention is directed to a protective sleeve system. In certain embodiments, the protective sleeve system is configured for both holding and protecting a held container. Accordingly, in certain embodiments, the protective sleeve system includes a protective sleeve (such as described above), which includes a tubular body, configured for holding a container, and at least a first opening, adapted for receiving the container, and in addition to the protective sleeve, the protective sleeve system may include a suitable container, such as those described above, for instance, a bottle, can, or other food storage element that is adapted to be fit and/or held within the protective sleeve.

For instance, in certain embodiments, the protective sleeve system includes a bottle, such as a glass or plastic bottle. In certain embodiments, the bottle is a water bottle, sports drink bottle, baby bottle, or the like. Accordingly, in certain embodiments, the silicone sleeve system serves as a healthy, ecological solution to many of the problems associated with using plastic containers.

Figure 2:
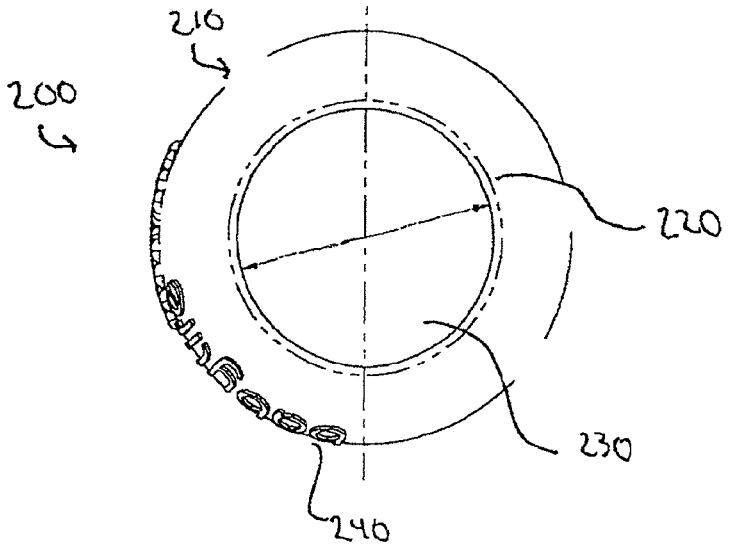
FIG. 2 illustrates an embodiment of a distal end of a protective sleeve in accordance with the disclosure.

Various embodiments of the subject invention will now be described with reference to the figures. For clarity and convenience, the container assembly is exemplified in the figures and below as a sleeve. However, as described above, other embodiments of sleeve and container assemblies are contemplated by the invention. FIG. 1 shows a perspective view and FIG. 2 shows a cross sectional view of an exemplary protective sleeve according to an illustrative, but non-limiting embodiment of the present invention.

As can be seen with reference to FIG. 1, in certain embodiments, a protective sleeve (100) of the subject invention includes a tubular body (110) that is adapted for receiving and holding a container (not shown), such as a drinking or baby bottle. As illustrated the protective sleeve (100) includes a plurality of holes (120), which are configured for allowing one to see a level of the contents of a container, when inserted into the sleeve.

The protective sleeve (100) additionally includes a first and second openings (130 and 140, respectively). The first opening (130) is adapted for receiving a container, and the second opening (140) is adapted for retaining the received container. For instance, as illustrated, the tubular body (110) includes a lip (150), which lip (150) is coextensive with the tubular body (110) and surrounds the first opening (130); and includes a second lip (160), which lip (160) is coextensive with the tubular body (110) and surrounds the second opening (140).

Additionally, the tubular body (110) includes a proximal and distal portions (112 and 114, respectively) which may or may not be tapered. The tubular body may also include one or more gripping elements (160 and 162), which may be one or more raised surface areas, which facilitate a users grasping of the protective sleeve. As can be seen with respect to FIG. 1, a gripping element (162) may be in the form of letters which form words, such as the word "babylife," as shown. The tubular body (110) may also be fabricated in such a manner as to include ribbing (116), which further functions to increase a user's ability to grip the protective sleeve (100). As described above, the protective sleeves of the invention may be made out of any suitable material, however, in certain embodiments, such as that illustrated in FIG. 1, the sleeve is fabricated from silicone, e.g., molded from a single piece of 100% silicone.

FIG. 2 sets forth a distal end (210) of a protective sleeve (200) of the subject invention. As depicted, the distal end (210) is tapered and includes a lip element (220) which surrounds an opening (230). Together the distal end (210) and lip element (220) function to retain a received container. The second opening is separated from a first opening by an extended tubular body (not shown). The distal end (210) further includes a raised surface element (240), which is in the form of the word "babylife."

Figure 3C:
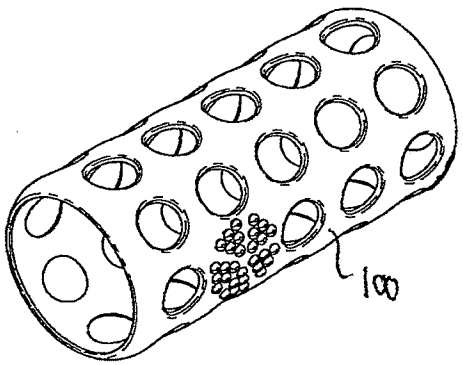
FIG. 3C illustrates a perspective view of the protective sleeve of FIG. 3. As illustrated the baby bottle may be an 8 oz baby bottle.
Figure 3B:
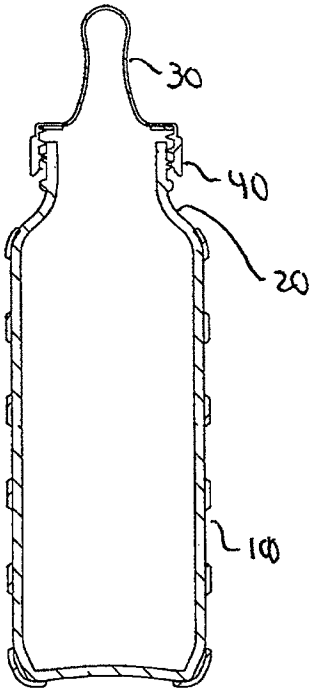
FIG. 3B represents a cross sectional view of the system of FIG. 3A.
Figure 3A:
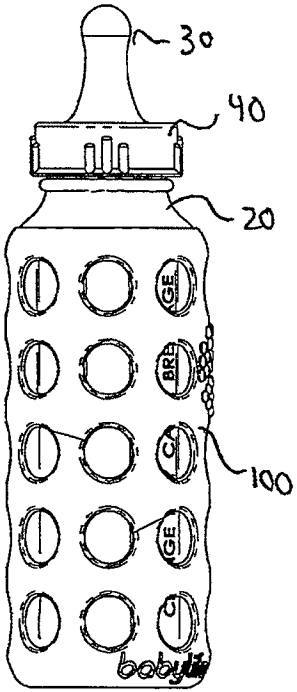
FIG. 3A represents a front perspective view of the baby bottle protective sleeve system.

FIG. 3 presents a baby bottle system in accordance with the above disclosure. The system (10) includes a baby bottle (20), a nipple (30), and a locking connector (40). The system also includes the protective sleeve (100) of FIG. 1. FIG. 3A shows a perspective view and FIG. 3B shows a cross sectional view of an embodiment of the system of FIG. 3. As can be seen with reference to FIG. 3A, the nipple (30) and the locking connector (40) are configured for being associated with one another so as to form a tight seal there between. For instance, the locking connector (40) may include an opening through which an extended portion of the nipple (30) is inserted (see FIG. 4C below). Additionally, as can be seen with reference to FIG. 3B, the connector (40) may be configured for being removably coupled to the baby bottle (20). For example, the baby bottle (20) and the connector (40) may have complimentary threading so as to allow the connector (40) with associated nipple (30) to be coupled to the baby bottle (20) such as by threading their respective threaded portions together. As depicted the baby bottle may be an eight or nine ounce baby bottle. As can be seen with respect to FIG. 3C, the protective sleeve (100), which sleeve may comprise silicone, may be removable from the baby bottle (20).

Figure 4B:
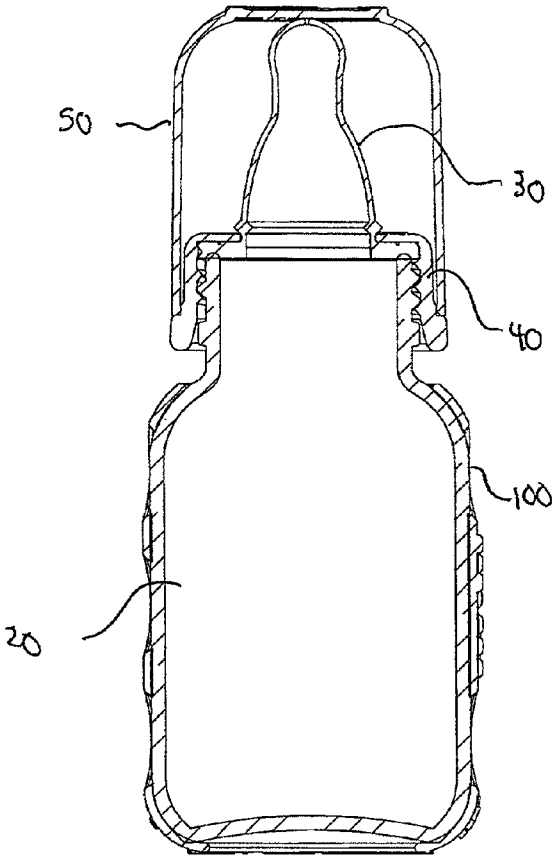
FIG. 4B represents a cross sectional view of the system of FIG. 4A.
Figure 4A:
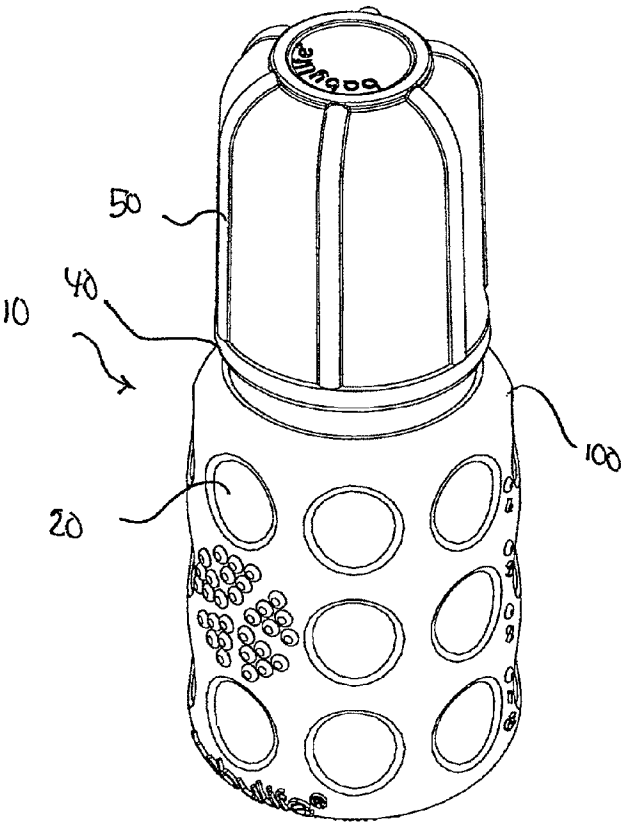
FIG. 4A represents a front perspective view of the baby bottle protective sleeve system.

FIG. 4 presents an alternative baby bottle system in accordance with the above disclosure. As depicted the baby bottle may be an four ounce baby bottle. The system (10) includes a baby bottle (20), a nipple (30), a locking connector (40), and a lid (50). The system also includes the protective sleeve (100) similar to the sleeve of FIG. 3. FIG. 4A shows a perspective view and FIG. 4B shows a cross sectional view of an embodiment of the system of FIG. 4. As can be seen with reference to FIG. 4A, the lid (50) may be adapted to be associated with the bottle (10) via a connector (40). In other embodiments, the lid (50) may be adapted to be associated with the bottle (10) directly without the intersession of a connector (40).

As can be seen with respect to FIG. 4B, the nipple (30) and the locking connector (40) are configured for being associated with one another so as to form a tight seal there between, as described above. Additionally, the connector (40) may be configured for being removably coupled to the baby bottle (20). For example, the baby bottle (20) and the connector (40) may have complimentary threading so as to allow the connector (40) with associated nipple (30) to be coupled to the baby bottle (20) such as by threading their respective threaded portions together. Further, the lid (50) is designed to fit over the nipple (30), so as to protect the nipple from the environment, and additionally, the lid (50) is configured for being removable coupled to the connector (40).

Figure 4C:
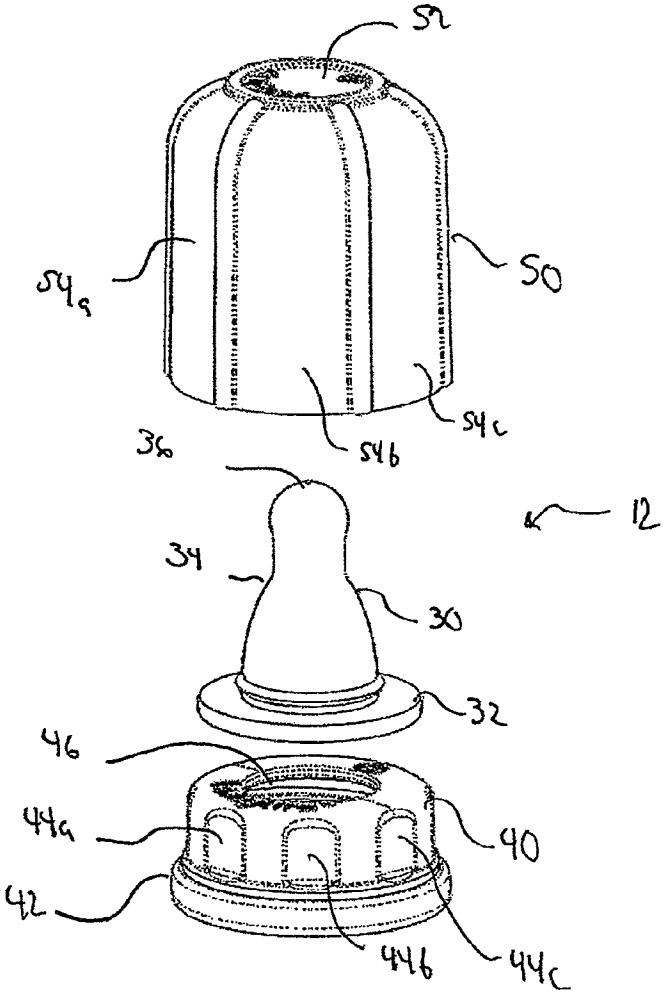
FIG. 4C illustrates an embodiment of the lid assembly of FIG. 4A including a cap and nipple in accordance with the disclosure. As illustrated the baby bottle may be a 4 oz baby bottle.

For example, as can be seen with reference to FIG. 4C, the lid (50), nipple (30), and connector (40), may form a lid assembly (12), wherein the connector (40) is configured much like a hexagonal nut having a plurality of indentations (e.g., 44*a*-44*c* shown, 44*d*-44*f* not shown) for allowing the connector (40) to be firmly grasped and manipulated. The connector (40) also includes a coupling element (42) that is configured for coupling the connector (40) to a bottle, and the connector (40) additionally includes an opening (46) through which an extended portion of the nipple (30) may extend. The nipple (30) may include a base element (32), and extended body portion (34), and an opening (36), through which opening a fluid, such as milk, may pass. The lid (50) may include a flattened portion (52) and a plurality of extended walls or sides (54*a*, 54*b*, 54*c* shown, 54*d*, 54*e*, 54*f* not shown) radiating away from the flattened portion (52). The lid (50) may be configured so as to stably be placed on a flat surface and to form a receptacle into which the contents of the container, e.g., a baby bottle, may be poured for drinking. The lid (50) is also adapted so as to fit over the nipple (30) and be removably associated with the connector (40).

Figure 5:
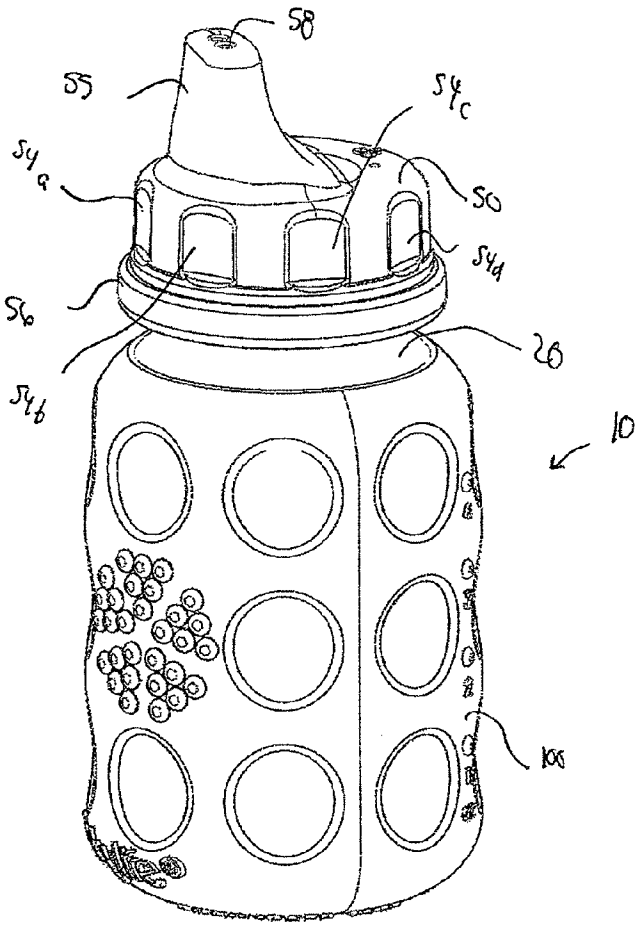
FIG. 5 illustrates an embodiment of a sippy cup including a protective sleeve in accordance with the disclosure.

FIG. 5 presents a bottle system, in accordance with the above disclosure, wherein the bottle system forms a sippy cup. The sippy cup system (10) includes a bottle (20), such as a four ounce bottle, and a lid (50), wherein the lid includes a spout (55). The system also includes the protective sleeve (100) similar to the sleeve of FIG. 4. As can be seen with reference to FIG. 5, the lid (50) includes a coupling element (56), which element may be configured so as to allow the lid (50) to be associated with the bottle (10). The spout (55) is a raised element containing at least one hole (58) adapted to allow fluid to pass there through. The lid (50) additionally includes indentations, such as (54*a*-*d*), which function to make the lid better capable of being gripped.

Figure 6A:
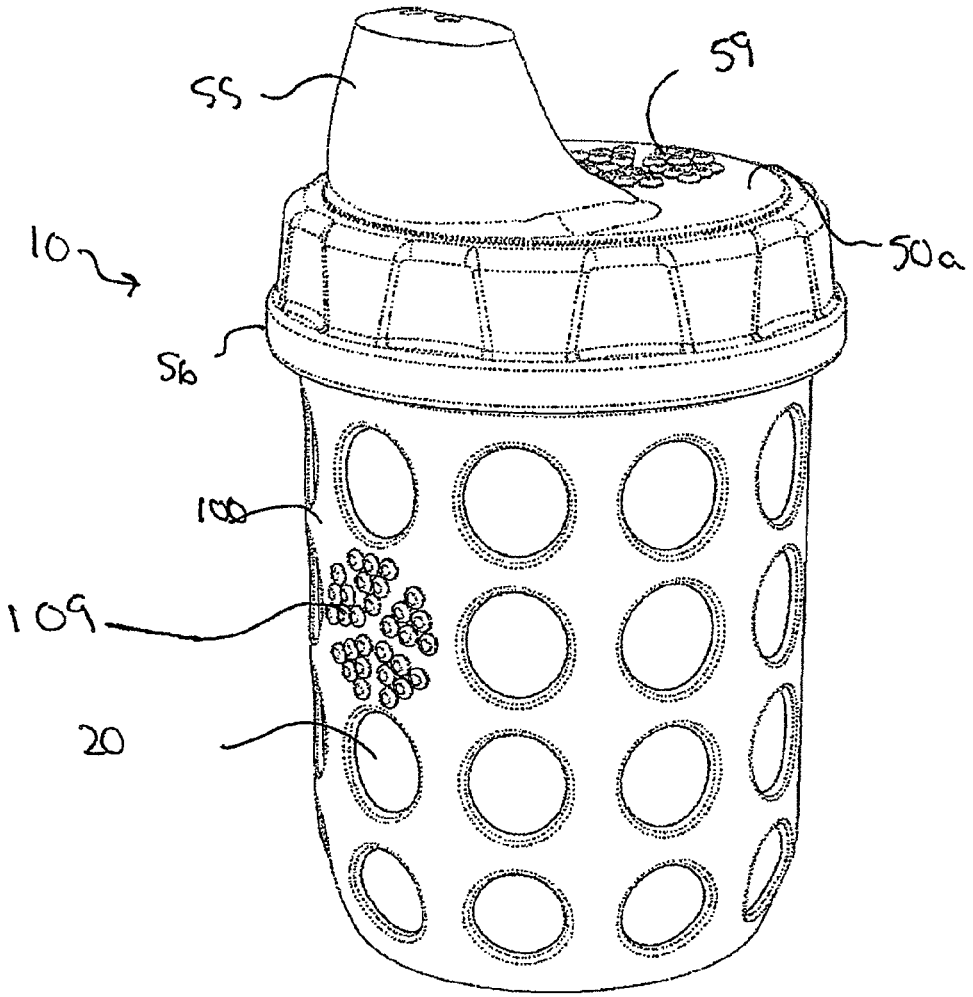
FIG. 6A presents a container with a lid that includes a spout, thereby converting the container to a sippy cup.
Figure 6B:
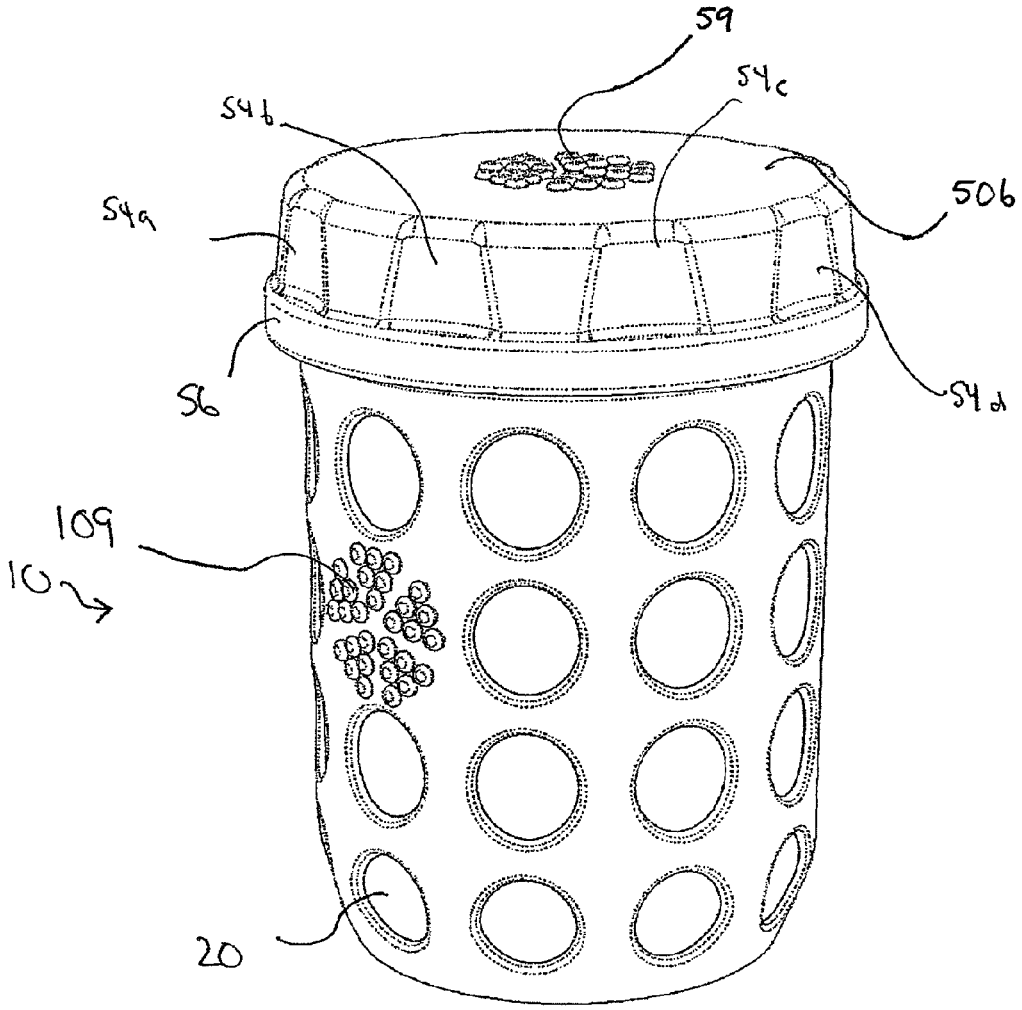
FIG. 6B presents a container with a lid that does not include a spout, thereby converting the container to a closeable container.

FIG. 6 presents an alternative bottle system to that of FIG. 5, which is in accordance with the above disclosure. The system of FIG. 6 includes a changeable lid for a bottle, wherein a first lid may include a spout, and thus form a sippy cup, when coupled to a bottle, and a second lid may not include a spout and thus form a storage container when coupled to the bottle. The sippy cup/storage system (10) includes a bottle (20), such as a four ounce bottle, and two lids (50*a* and 50*b*), wherein lid (50*a*) includes a spout (55) and lid (50*b*) does not include a spout. The system also includes the protective sleeve (100) similar to the sleeve of FIG. 5. As can be seen with reference to FIG. 6, the lid (50) includes a coupling element 56, which element may be configured so as to allow the lid (55) to be associated with the bottle (10). The lid (55) additionally includes indentations, such as (54*a*-*d*), which function to make the lid better capable of being gripped. Additionally, as depicted, both the lid (55) and the protective sleeve (100), include raised gripping element (59 and 109, respectively).

FIG. 7 shows a perspective view of another exemplary protective sleeve system according to an illustrative, but non-limiting embodiment of the present invention. As can be seen with reference to FIG. 7, in certain embodiments, a protective sleeve system (10) of the subject invention includes a bottle (20), such as a sports bottle, and a lid assembly (5). The lid assembly (5) includes a nozzle (30), and a locking connector (40). The system also includes a protective sleeve (100). The sports bottle (20) is configured for retaining a fluid therein. The connector (40) is configured for being removably coupled to the sports bottle (20). For example, the sports bottle (20) and the connector (40) may have complimentary threading so as to allow the connector (40) with the associated nozzle (30) to be coupled to the sports bottle (20) such as by threading their respective threaded portions together. The nozzle (30) is configured for moving from a closed to an open position. When in an open position, the nozzle (30) allows the passage of fluid from within the bottle through the nozzle; and when in the closed position, the nozzle prevents fluid from flowing through the nozzle.

Figure 7A:
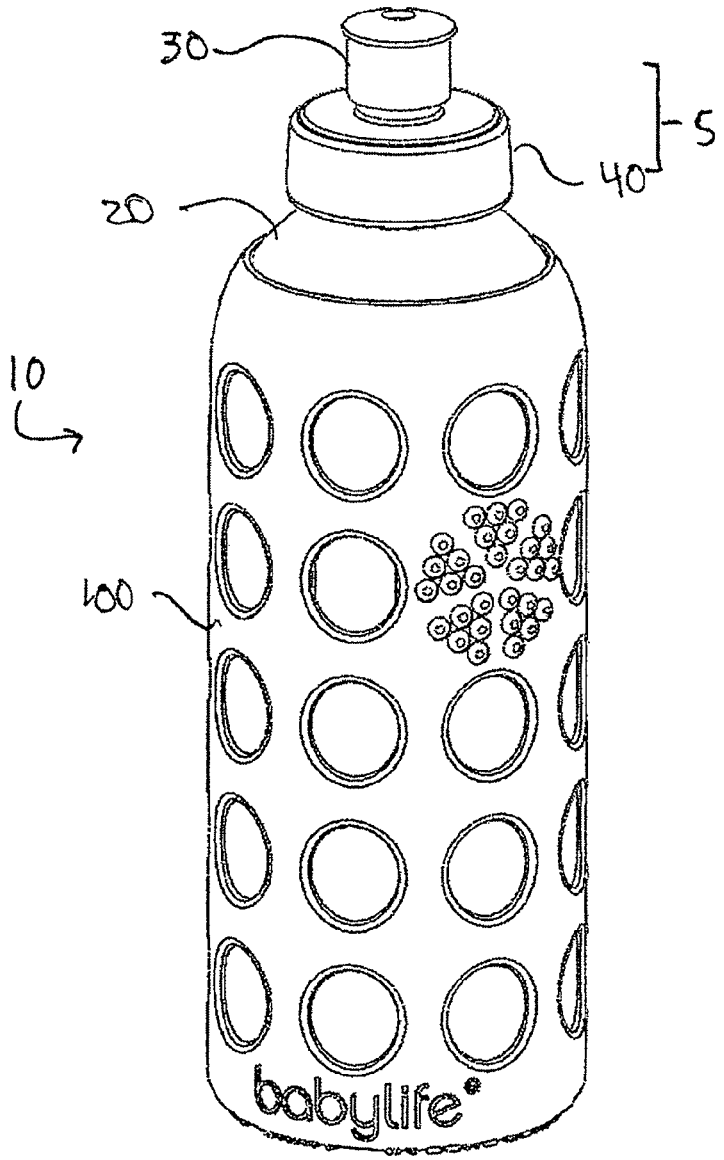
FIG. 7A represents a front perspective view of one embodiment of the system.
Figure 7B:
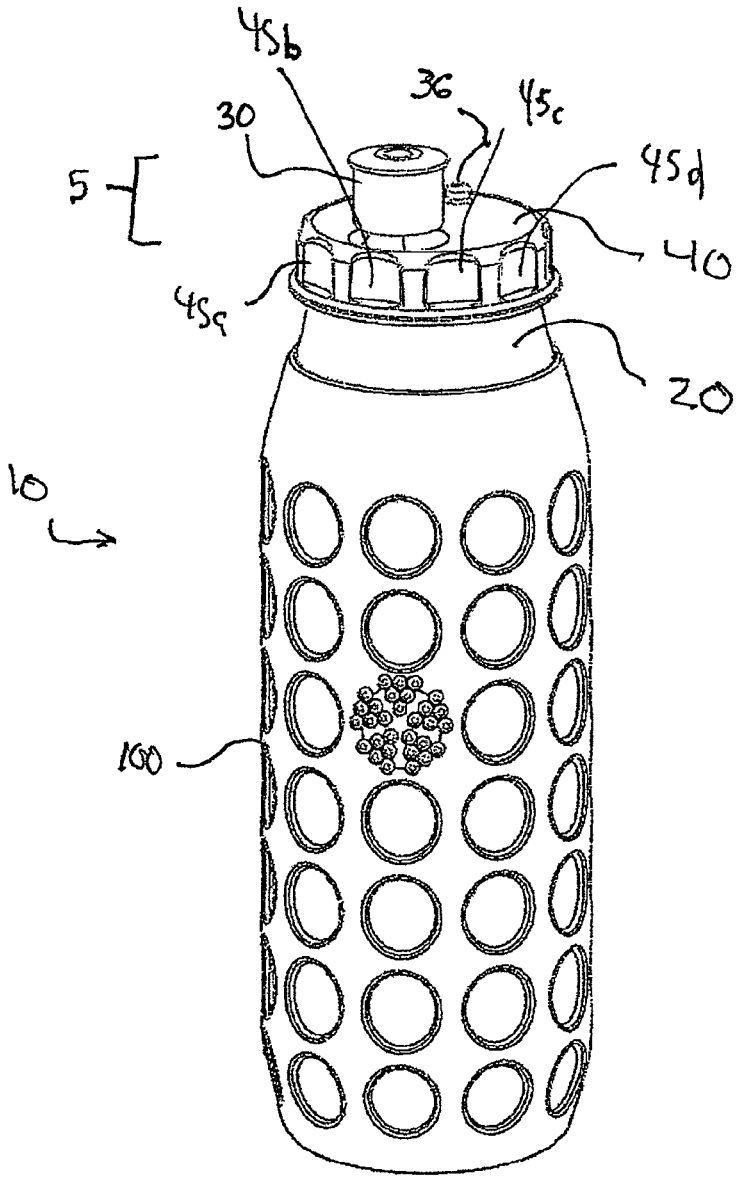
FIG. 7B represents a perspective view of another embodiment of the system.

As can be seen with respect to FIGS. 7A and 7B, the connector portion (40) of the lid assembly (5) can be rounded and smooth, e.g., without indentations, or the connector portion (40) may include one or more indentations, such as 45*a*-45*d* of FIG. 7B. An additional venting element (36) may also be included in the lid assembly 5 (see FIG. 7A). As can be seen with respect to FIG. 7, the sports bottle may have variety of different shapes and sizes. For instance, the bottle may have a height that may be about 170 mm, for example, or about 230 mm, or even about 265 mm, for instance. The bottle may be shaped to have an additional neck element, which element may have a height that ranges from 10 mm or less to about 30 mm or more, such as about 20 or 22 mm to about 25 mm. In such an instance, the neck opening may have different shapes as well, for instance, in a particular embodiment, the opening in the neck may range, for example, from 10 mm or less to about 70 mm or more, such as from about 30 mm to about 60 mm, including about 40 mm to about 50 mm. The bottle may be shaped to hold a variety of different volumes of fluids, for instance, some exemplary volumes may include about 500 ml or less, for instance about 750 ml, such as 1 L, including 2 L or more.

Figure 8:
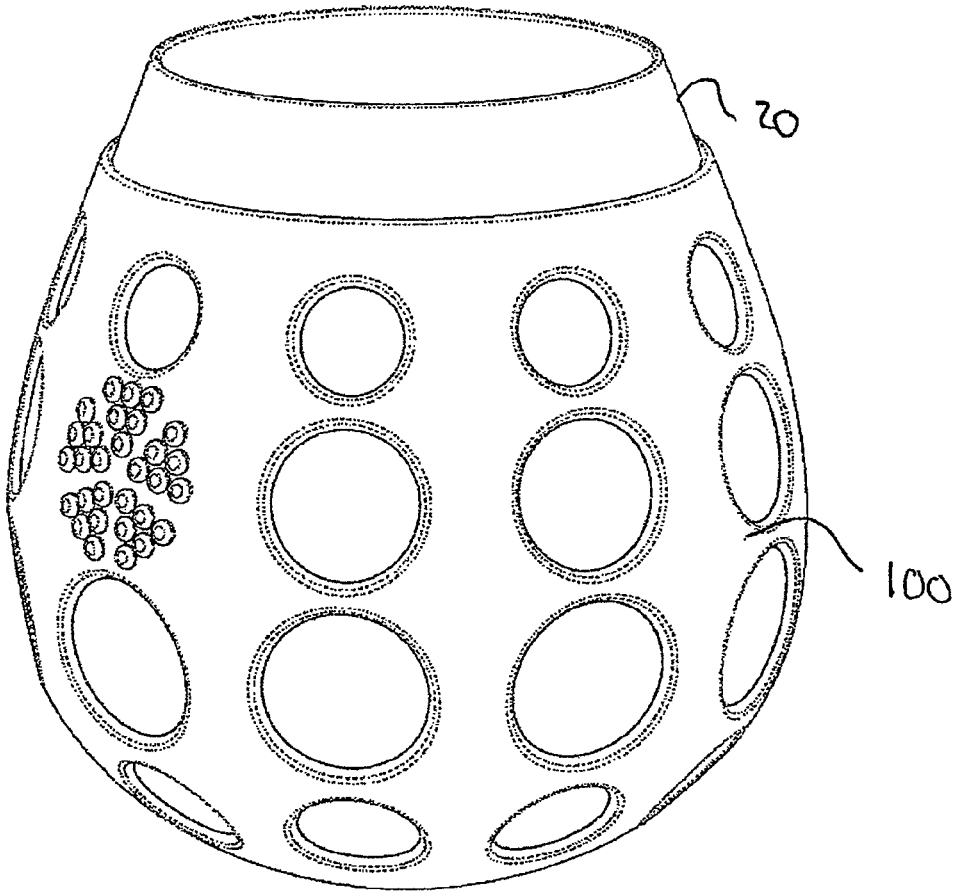
FIG. 8 illustrates an embodiment of a wine glass including a protective sleeve in accordance with the disclosure.

As can be seen with respect to FIG. 8, the protective sleeve of the disclosure may be dimensioned to fit a number of different drinking and eating instruments, such as cups, glasses, pitchers, bowls, plates, and the like. For instance, as depicted in FIG. 8, a protective sleeve (100) has been designed so as to fit a wine glass (20), e.g., a stemless wineglass, for the protection thereof.

Figure 9:
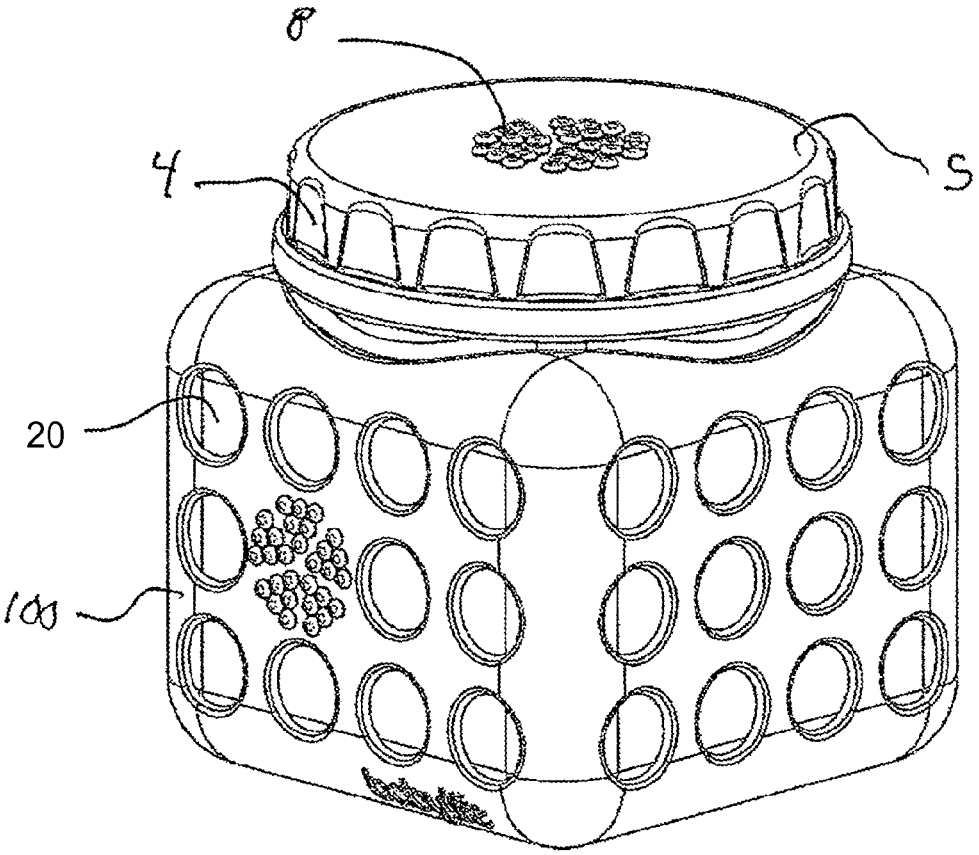
FIG. 9 illustrates an embodiment of a food storage container including a protective sleeve in accordance with the disclosure.

As can be seen with respect to FIG. 9, the protective sleeve of the disclosure may be dimensioned to fit a number of different drink and/or food storage elements, such as food containers of any of a number of different shapes and sizes. For instance, as depicted in FIG. 9, a protective sleeve (100) has been designed so as to fit a food container (20), e.g., a jelly container, for the protection thereof. The food container (20)

includes a removable lid (5). As depicted the lid (5) may optionally have indentations (4) and an additional gripping element (8).

Figure 10:
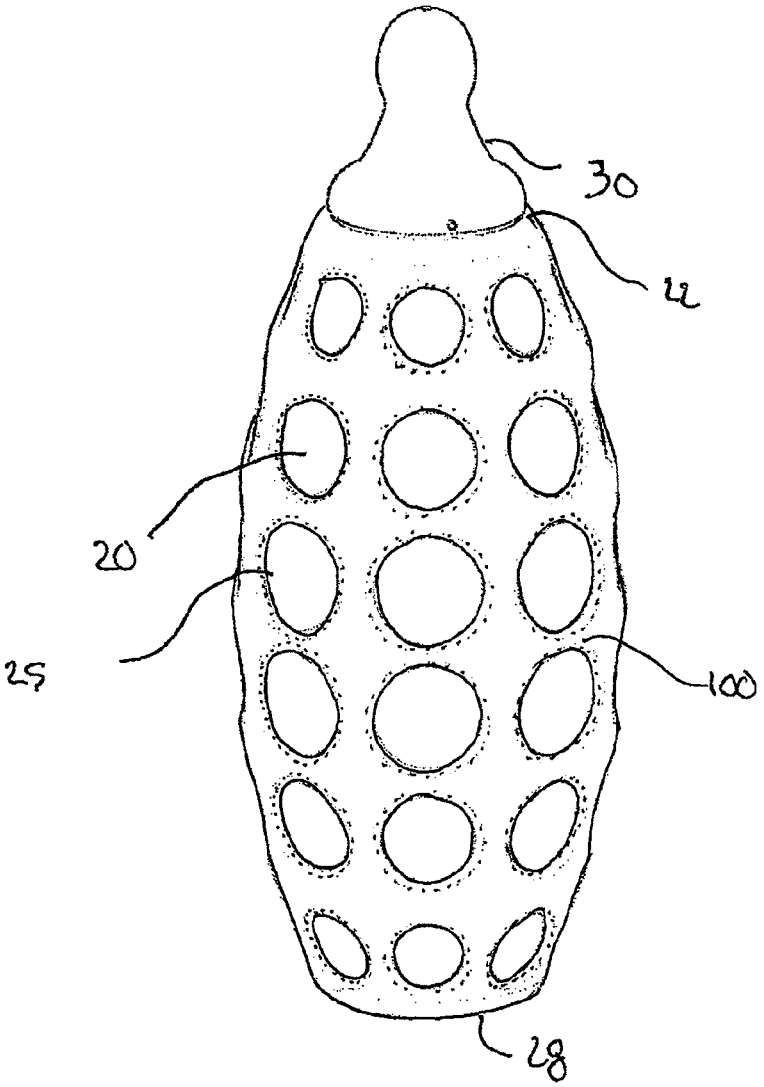
FIG. 10 illustrates an embodiment of a protective sleeve and baby bottle system in accordance with the invention.

FIG. 10 shows a perspective view of another exemplary protective sleeve system according to an illustrative, but non-limiting embodiment of the present invention. As can be seen with reference to FIG. 10, in certain embodiments, a protective sleeve system (10) of the subject invention includes a bottle (20), such as a baby bottle and a nipple (30), wherein the nipple (30) is configured to be directly coupled to the baby bottle (20). The system also includes a protective sleeve (100). As depicted the baby bottle (20) is curved, tapering away from the midpoint (25) thereof, which midpoint has a greater diameter as compared to the ends (22 and 28, respectively) of the bottle (20).

As can be seen with respect to FIG. 10, the baby bottle may have variety of different shapes and sizes. For instance, the baby bottle may have a height that may be about 60 mm, for example, or about 80 mm or 90 mm, or even 130 mm or 140 mm, for instance. The baby bottle may be shaped to have an additional neck element, which element may have a height that ranges from 20 mm or less to about 30 mm or more, such as about 22 mm to about 25 mm. In such an instance, the neck opening may have different shapes as well, for instance, in a particular embodiment, the opening in the neck may range, for example, from 10 mm or less to about 70 mm or more, such as from about 30 mm to about 50 mm, including about 40 mm. The bottle may be shaped to hold a variety of different volumes of fluids, for instance, some exemplary volumes may include about 125 ml or less, for instance about 240 ml, such as 260 ml, including 280 ml or more. In certain instances, the bottle may be configured to hold a feed solution of about 4 or less ounces to about 8 or more ounces, and thus, the baby bottle may be termed a 4 oz or 8 oz baby bottle.

Figure 11:
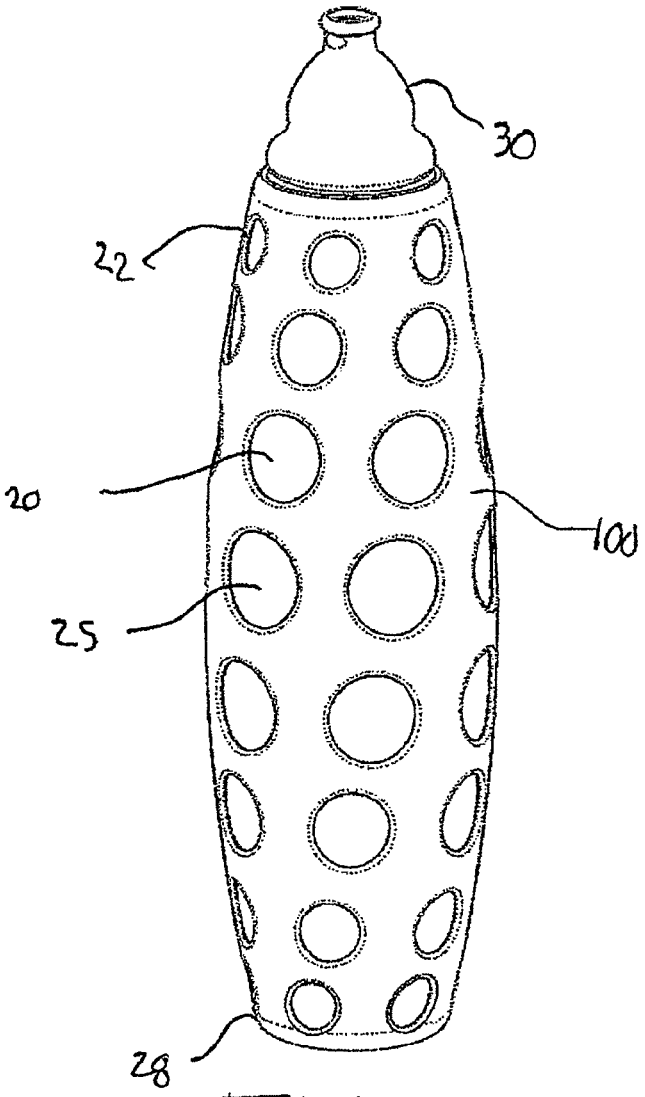
FIG. 11 illustrates an embodiment of a protective sleeve and drinking bottle system in accordance with the invention.

FIG. 11 shows a perspective view of another exemplary protective sleeve system according to an illustrative, but non-limiting embodiment of the present invention. As can be seen with reference to FIG. 11, in certain embodiments, a protective sleeve system (10) of the subject invention includes a bottle (20), such as a drinking bottle and a nozzle (30), wherein the nozzle (30) is configured to be directly coupled to the drinking bottle (20). The system also includes a protective sleeve (100). As depicted the drinking bottle (20) is curved, tapering away from the midpoint (25) thereof, which midpoint has a greater diameter as compared to the ends (22 and 28, respectively) of the bottle (20).

Figure 12:
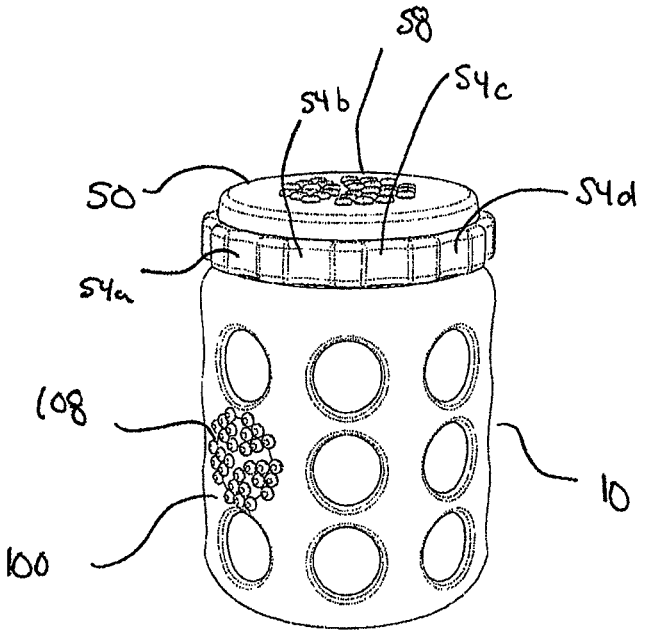
FIGS. 12 and 13 illustrate an embodiment of a container system that includes two containers of different sizes with lids each of which includes a protective sleeve.
Figure 13:
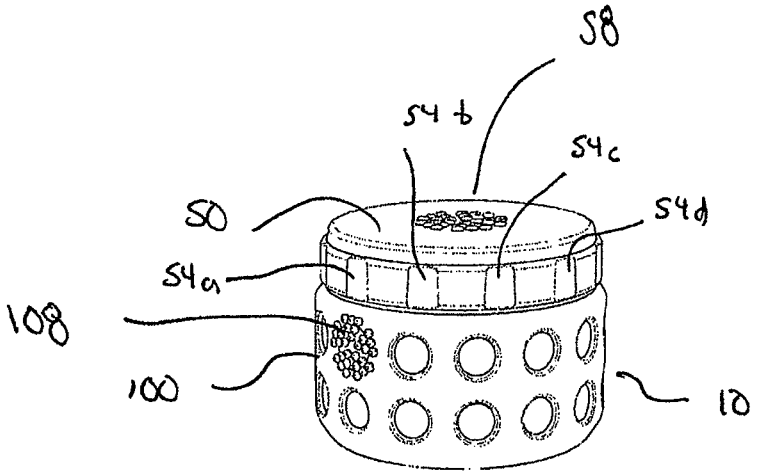

With respect to FIGS. 12 and 13, these figures illustrate an embodiment of a container system that includes two containers of different sizes with lids, each of which includes a protective sleeve. The container system of FIGS. 12 and 13 is designed to include a plurality of containers, in this instance: two, which are of different sizes and are meant to carry different quantities and/or types of food products, for instance, as a mobile lunch system. For example, the container with protective sleeve could include a first food, such as a first baby food, and the second container could include a second food, such as a second baby food, such that the two foods when combined together provide for a well balanced lunch.

Accordingly, FIGS. 12 and 13 present a container system, such as a lunch system, which includes a plurality of containers. The containers (20) include a protective sleeve (100) and a lid (50). The lid (50) additionally includes indentations, such as (54*a-d*), which function to make the lid better capable of being gripped. Both the lid (50) and the protective sleeve (100) include additional gripping elements (58 and 108, respectively). The container of FIG. 12 is of a different size than that of the container of FIG. 13. For instance, the container of FIG. 12 could be a six ounce container, and the container of FIG. 13 could be a four ounce container.

However, in certain embodiments, the containers of the container system may include a plurality of containers of the same size, e.g., volume. Further, although only two containers are depicted, the container system could include three, four, five, six, or more containers, wherein the containers can be of the same or different sizes and/or contain the same type or a different type of food or nutrient items. For instance, the volumes of the different containers may range, for example, from 3 ounces to 12 ounces. Additionally, although the containers are depicted as round, and bottle shaped, they could as well be square, rectangular, and the like. In this manner the container system provides for a breakfast, lunch, dinner, and/or snack system that allows the same or different food stuffs to be stored and contained in different containers to preserve freshness as well as transportability.

All publications and patents cited in this specification are herein incorporated by reference as if each individual publication or patent were specifically and individually indicated to be incorporated by reference.

While the invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the invention. All such modifications are intended to be within the scope of the claims appended hereto.

What is claimed is:

1. A container system comprising:

a container having side walls, a top opening and a bottom, the top opening having a diameter similar in size to the side walls; and a molded, removable protective sleeve having a first end, a second end and a middle section extending between the first end and the second end, wherein the first end has a first opening configured for receiving the container, wherein the middle section extends over the side walls of the container, and wherein the second end covers at least a portion of the bottom of the container;

wherein the protective sleeve comprises an elastic material, wherein the first opening of the protective sleeve comprised of elastic material is capable of stretching to an expanded position, and wherein the expanded position enables the protective sleeve to receive the container through the first opening;

wherein the protective sleeve is sized to snugly fit the container when the protective sleeve is on the container; and wherein the middle section comprises a plurality of holes, wherein the holes are sized and positioned to enable visual observation of contents within the container.

2. The container of claim 1 wherein the second end of the protective sleeve comprises a second opening.

3. The container of claim 2 wherein the second end is configured to prevent any portion of the container from passing through the second opening.

4. The container of claim 1 wherein the first end of the sleeve is tapered inward toward the first opening when the container is absent from the sleeve.

5. The container of claim 1 wherein the first opening of the protective sleeve, when the protective sleeve is not holding the container, has a cross section that is smaller than all parallel cross sections along a length of the middle section of the protective sleeve.

6. The container of claim 1 wherein the first opening of the protective sleeve is configured to retract and conform to a shape of the container near the top opening to prevent removal of the container from the protective sleeve without first stretching the protective sleeve near the first opening.

7. The container of claim 1 wherein the container is round, square, rectangular, or triangular in shape.

8. The container of claim 1 wherein the elastic material comprises silicone.

9. The container of claim 1 wherein the protective sleeve is capable of stretching from an original configuration so as to receive the container, and return to its original configuration once the container has been removed from the protective sleeve.

10. The container of claim 1 wherein the container is a food container.

11. The container of claim 1 wherein the container is a drinking glass.

12. The container of claim 11 wherein the drinking glass is a wine glass.

13. The container of claim 1 wherein the container is a glass water bottle.

14. The container of claim 1 wherein the top opening of the container has a diameter that is at least 70% of the diameter of the side walls of the container.

15. A food container system comprising:

a food container having side walls, a top opening and a bottom, the top opening having a diameter similar in size to the side walls; and a molded, removable protective sleeve having a first end, a second end and a middle section extending between the first end and the second end, the protective sleeve comprising an elastic material;

wherein the first end tapers inward relative to the middle section when the container is removed from the protective sleeve, the first end being located on the side walls when the protective sleeve is placed on the food container, and wherein the first end has a first opening configured to receive the container when the first opening of the protective sleeve comprised of elastic material is stretched to an expanded position;

wherein the middle section extends over the side walls of the container, the middle section comprising a plurality of holes sized and positioned to enable visual observation of contents within the container;

wherein the second end comprises a bottom edge surrounding a second opening; and wherein the bottom edge covers at least a portion of the bottom of the container.

16. The container of claim 15 wherein the protective sleeve is dimensioned to snugly fit the container.

17. The container of claim 15 wherein the second end is configured to prevent any portion of the container from passing through the second opening.

18. The container of claim 15 wherein the first opening of the protective sleeve is configured to retract and conform to a shape of the container near the top opening to prevent removal of the container from the protective sleeve without first stretching the protective sleeve near the first opening.

19. The container of claim 15 wherein the top opening of the container has a diameter that is at least 70% of the diameter of the side walls of the container.

20. A drinking container system comprising:

a drinking container having side walls, a top opening and a bottom, the top opening having a diameter similar in size to the side walls; and a molded, removable protective sleeve having a first end, a second end and a middle section extending between the first end and the second end, the protective sleeve comprising an elastic material;

wherein the first end tapers inward relative to the middle section when the container is removed from the protective sleeve, the first end being located on the side walls when the protective sleeve is placed on the food container, and wherein the first end has a first opening configured to receive the container when the first opening of the protective sleeve comprised of elastic material is stretched to an expanded position;

wherein the middle section extends over the side walls of the container, the middle section comprising a plurality of holes sized and positioned to enable visual observation of contents within the container;

wherein the second end comprises a bottom edge surrounding a second opening; and wherein the bottom edge covers at least a portion of the bottom of the container.

21. The container of claim 20 wherein the protective sleeve is dimensioned to snugly fit the container.

22. The container of claim 20 wherein the second end is configured to prevent any portion of the container from passing through the second opening.

23. The container of claim 20 wherein the first opening of the protective sleeve is configured to retract and conform to a shape of the container near the top opening to prevent removal of the container from the protective sleeve without first stretching the protective sleeve near the first opening.

24. The container of claim 20 wherein the drinking container is a drinking glass.

25. The container of claim 24 wherein the drinking glass is a wine glass.

26. The container of claim 20 wherein the top opening of the container has a diameter that is at least 70% of the diameter of the side walls of the container.

* * * * *

UNITED STATES PATENT AND TRADEMARK OFFICE

CERTIFICATE OF CORRECTION

PATENT NO. : 9,266,643 B2
APPLICATION NO. : 14/034874
DATED : February 23, 2016
INVENTOR(S) : Marcus et al.

It is certified that error appears in the above-identified patent and that said Letters Patent is hereby corrected as shown below:

In the claims,
In column 18, line 24 (Claim 20), please delete "food" and insert --drinking--.

Signed and Sealed this
Twenty-fourth Day of May, 2016

Michelle K. Lee

Michelle K. Lee
*Director of the United States Patent and Trademark Office*